US006242859B1

(12) United States Patent
Betsui et al.

(10) Patent No.: US 6,242,859 B1
(45) **Date of Patent: *Jun. 5, 2001**

(54) PLASMA DISPLAY PANEL AND METHOD OF MANUFACTURING SAME

(75) Inventors: Keiichi Betsui; Akira Nakazawa; Shigeo Kasahara; Shinya Fukuta; Noriyuki Awaji, all of Kawasaki (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/052,926

(22) Filed: Apr. 1, 1998

(30) Foreign Application Priority Data

Apr. 10, 1997 (JP) ..... 9-092604
Feb. 17, 1998 (JP) ..... 10-034736

(51) Int. Cl.[7] ..... H01J 17/49
(52) U.S. Cl. ..... 313/584; 445/24
(58) Field of Search ..... 445/25, 24; 313/582, 313/584

(56) References Cited

U.S. PATENT DOCUMENTS 5,886,467 * 3/1999 Kimura ..... 313/584
5,898,271 * 4/1999 Mehrotra et al. ..... 313/584

FOREIGN PATENT DOCUMENTS 06310036 11/1994 (JP) .
06267424 9/1997 (JP) .

* cited by examiner

*Primary Examiner*—Kenneth J. Ramsey
(74) *Attorney, Agent, or Firm*—Staas & Halsey LLP

(57) ABSTRACT

In the present invention, the process of forming the dielectric layer is carried out by laminating a dielectric thin film sheet on a substrate. Alternatively, it is carried out by sealing together a dielectric thin film sheet and the rear-side substrate whilst leaving a discharge gap therebetween. In particular, by using a dielectric thin film sheet to constitute the dielectric layer formed onto the display-side substrate, which must be transparent, the conventional processes of printing and anneling become unnecessary. For this dielectric thin film sheet, a micro-sheet comprising borosilicate glass or soda-lime glass as a principal component is used. This micro-sheet may have a thickness of 5 $\mu$m or less, and it is suitable as a dielectric layer for a plasma display panel.

34 Claims, 17 Drawing Sheets

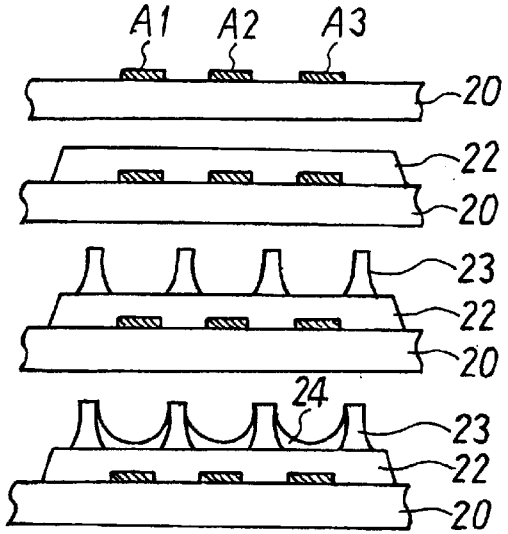
FIG. 2D
FIG. 2E
FIG. 2F
FIG. 2G
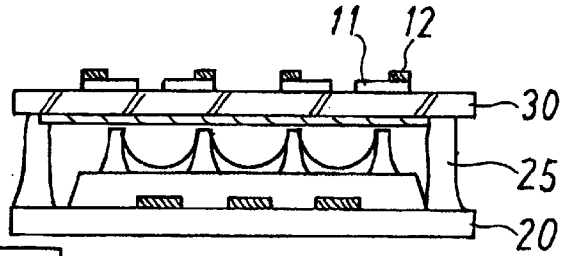
FIG. 2H
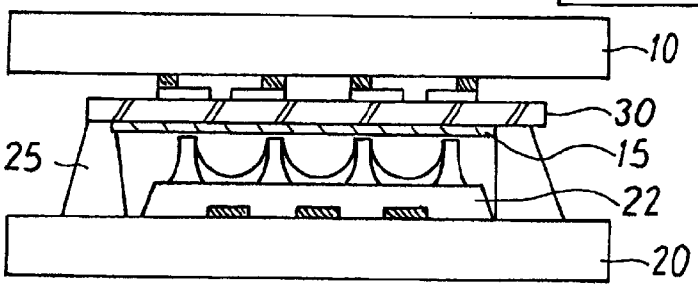
FIG. 2I
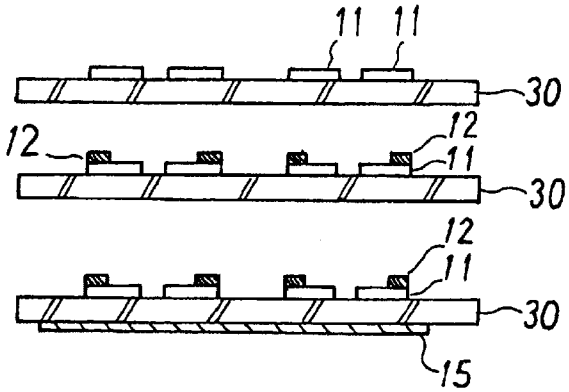
FIG. 2A
FIG. 2B
FIG. 2C

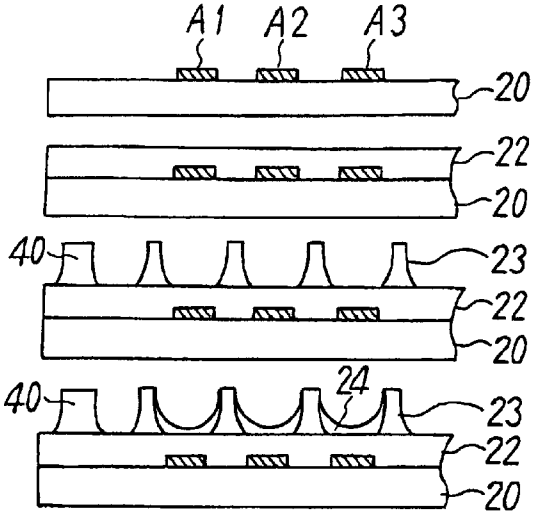
FIG. 13D
FIG. 13E
FIG. 13F
FIG. 13G
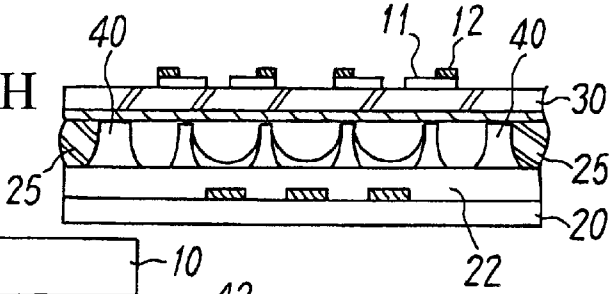
FIG. 13H
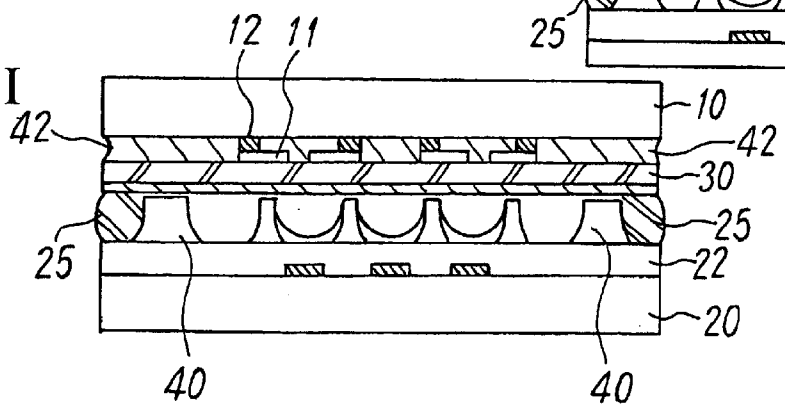
FIG. 13I
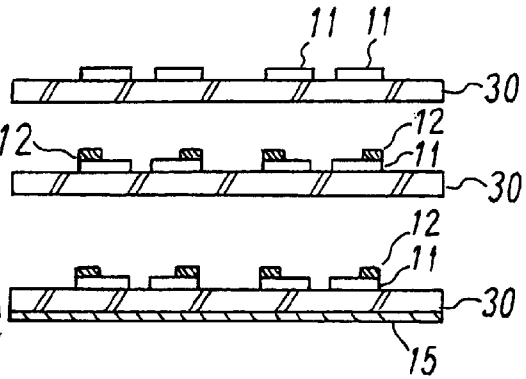
FIG. 13A
FIG. 13B
FIG. 13C

MODIFICATION OF FIG. 16

PLASMA DISPLAY PANEL AND METHOD OF MANUFACTURING SAME

BACKGROUND OF THE INVENTION

1. Field of the Invention

The present invention relates to a novel structure of a plasma display panel, and a novel method of manufacturing same whereby printing and annealing processes for forming a dielectric layer are eliminated.

2. Description of the Related Art

Plasma display panels (hereafter, abbreviated to PDP,) have received attention as large-screen full-colour display devices. In particular, in three-electrode surface-discharge AC-type PDPs, a plurality of display electrode pairs for generating surface discharges are formed on the display side of a substrate, and address electrodes orthogonal to these display electrode pairs, and a fluorescent layer covering these, are formed on the rear side of the substrate. Essentially, the device is driven by applying a large voltage to the display electrode pairs to reset the display, creating address discharges between one of the electrodes in the display electrode pairs and an address electrode, and generating sustain discharges using wall electric charges generated by address discharges created when a sustain voltage is applied between the display electrode pairs. The fluorescent layer generates RGB (red, green, blue) fluorescent light, for example, due to the ultraviolet rays generated by the susatin discharge, thereby producing a full-colour display. Consequently, a transparent electrode material is used for the display electrode pairs formed on the display side of the substrate.

This transparent electrode material is typically a semiconductor made from ITO (indium oxide $In_2O_3$ and tin oxide $SnO_2$ semiconductor), and its conductivity is low compared to metal, or the like. Therefore, in order to raise the conductivity, a fine metal conductive layer is applied onto the transparent electrodes.

FIG. 8 shows a general dissembled oblique view of the aforementioned three-electrode surface-discharge AC-type PDP. In this example, the display light is emitted in the direction of the display-side glass substrate 10 (the upward direction in FIG. 8). 20 is a rear-side glass substrate. An X electrode 13X and a Y electrode 13Y, each comprising a transparent electrode 11 and a bus electrode 12 of high conductivity formed thereon (therebelow in the drawing), are formed onto the display-side glass substrate 10 and this display electrode pair is covered by a dielectric layer 14 and protective layer 15 of MgO. The bus electrodes 12 are provided running between opposite ends of the X electrode and Y electrode to supplement the conductivity of the transparent electrodes 11.

The bus electrodes 12 are metal electrodes having a chrome/copper/chrome triple-layer structure, for example. The transparent electrodes 11 are usually made from ITO (Indium tin oxide: Indium oxide $In_2O_3$ and tin oxide $SnO_2$ semiconductor). The dielectric layer 14 is usually formed from a low-melting-point glass material whose principal component is lead oxide, and more specifically, it is a $PbO—SiO_2—B_2O_3—Zn$ glass.

On the rear-side glass substrate 20, strip-shaped address electrodes A1, A2, A3 are provided on a base passivation film 21 made from silicon oxide film, or the like, and they are covered by a dielectric layer 22. The address electrodes A are formed such that they are positioned between strip-shaped partitions (ribs) 23. These ribs 23 have two functions, namely, to prevent any effects on adjacent cells during discharge and to prevent cross-talk of the light. At adjacent ribs 23, red, green and blue fluorescent layers 24R, 24G, 24B are coated separately such that they cover the address electrodes and the side walls of the rib partitions. The display-side substrate 10 and the rear-side substrate 20 are assembled leaving a gap of approximately 100 $\mu$m, and a mixed discharge gas of Ne+Xe is sealed in the gap 25 therebetween. FIG. 9 gives sectional views illustrating an approximate manufacturing process for the PDP in FIG. 8. FIGS. 9(*a*)–(*d*) and FIGS. 9(*e*)–(*h*) show processes for the display-side substrate and processes for the rear-side substrate, respectively, and FIGS. 9(*i*) shows a state where the two substrates are bonded together. A brief description of the manufacturing process is now given.

Firstly, as shown in FIGS. 9(*a*)–(*d*), an electrode pair 11 comprising an X electrode and Y electrode made from transparent electrodes is formed by sputtering, or the like, onto the display side glass substrate 10. Bus electrodes 12 are then formed thereon. A dielectric layer 14 is then formed covering these electrodes. This dielectric layer 14 is formed, for example, by fabricating glass powder in the form of a paste onto the surface of a substrate by screen printing, or the like, and then annealing for a long period at a high temperature of 600° C. or the like. A protective layer 15 of MgO, for example, is then formed onto the dielectric layer 14.

On the other hand, as shown in FIGS. 9(*e*)–(*h*), the address electrodes A are formed onto the rear-side glass substrate 20 by sputtering, and a dielectric layer 22 is formed thereon similarly to the foregoing. Partitions (ribs) 23 comprising thick dielectric material layer are then formed by sand-blasting, and fluorescent layers 24 are formed in the grooves between these ribs.

Thereupon, as shown in FIG. 9(*i*), the two substrates 10, 20 are finally sealed at 400° C. by a sealing material 25, and using a hole (omitted from diagram) formed in the side of the rear-side substrate, the gas between the substrates is expelled under a raised temperature atmosphere, a discharge gas is introduced therein and the hole is sealed. For the sake of convenience, this diagram shows the display electrode pairs 11 rotated through 90°.

The dielectric layer 14 formed on the display-side glass substrate 10 has a memory function whereby it accumulates the wall charges generated during plasma discharge, and this layer is necessary for the subsequent sustain discharge. Furthermore, in order to direct the light from the fluorescent layers 24 outside the display-side glass substrate 10, it is desirable for the display electrode pairs 11 to be transparent electrodes.

However, as described above, the formation of the dielectric layer 14 involves a complicated and time-consuming process whereby glass granules of relatively even diameter are fabricated and formed into a paste by mixing them with a solvent, and they are then screen printed and left for a long period of time in a high-temperature annealing atmosphere. In particular, it is necessary that the dielectric layer 14 formed onto the display-side substrate is transparent. Therefore, it is imperative to avoid leaving internal bubbles generated during annealing, and this requires complete removal of the bubbles by means of a high-temperature annealing process. Dielectric breakdown may also occur as a result of bubbles. Consequently, it is desirable for the process of forming this dielectric layer 14 to be simplified.

Moreover, when the glass paste is annealed after screen printing, the dielectric layer 14 will not necessarily be of even thickness. Therefore, a variation is produced in the discharge start voltage in the address period and the discharge start voltage in the sustain period. Moreover, a number of bubbles are left unavoidably in the dielectric layer 14, even after annealing at high temperature, and if there is a variation in the thickness of the dielectric layer 14, transparency will be impaired in the thicker portions of the dielectric layer 14.

Furthermore, to increase the strength of the PDP, compressed reinforced glass is usually bonded to the display-side glass substrate. Since the annealing process for the dielectric layer 14 is conducted at a high temperature of 600° C., and the process of sealing to the rear-side substrate 20 is also conducted at a high temperature of 400° C., the strength due to reinforcement by compression will be lost in the high-temperature annealing and sealing process, and therefore reinforced glass cannot be used for the display-side substrate. Consequently, it is necessary to use reinforced glass to raise strength in addition to the two glass substrates 10, 20 subjected to high-temperature processing, and this leads to increases in cost and weight.

SUMMARY OF THE INVENTION

Therefore, it is an object of the present invention to provide a PDP and a method of manufacturing same whereby the manufacturing process for the dielectric layer 14 can be simplified.

It is a further object of the present invention to provide a method of manufacturing a PDP and an accompanying PDP composition, whereby reinforced glass can be used in the display-side substrate.

It is a further object of the present invention to provide a method of manufacturing a PDP and an accompanying PDP composition, whereby there is little variation in discharge characteristics.

In order to achieve the aforementioned objects, in the present invention, the process of forming the dielectric layer is carried out by laminating a dielectric thin film sheet on a substrate. Alternatively, it is carried out by sealing together a dielectric thin film sheet and the rear-side substrate whilst leaving a discharge gap therebetween. In particular, by using a dielectric thin film sheet to constitute the dielectric layer formed onto the display-side substrate, which must be transparent, the conventional processes of printing and anneling become unnecessary. For this dielectric thin film sheet, a micro-sheet comprising borosilicate glass or soda-lime glass as a principal component is used. This micro-sheet may have a thickness of 50 $\mu$m or less, and it is suitable as a dielectric layer for a plasma display panel.

In a method of manufacturing a plasma display panel comprising a first substrate having a plurality of first electrodes provided in parallel, a second substrate having a plurality of second electrodes provided in an orthogonal direction to said first electrodes, and a discharge space between the two substrates, the method of manufacturing according to the present invention comprises the steps of: sealing a dielectric thin film sheet, on the surface of which said first electrodes are formed, and the second substrates, on which said second electrodes are formed, such that said discharge space is formed therebetween; and attaching said first substrate to said sealed dielectric thin film sheet.

The process of laminating or attaching the first substrate to the dielectric thin film sheet is carried out, for example, by electrostatic bonding or in an atmosphere above the glass transition temperature. Furthermore, by laminating a metal foil forming a thin film of conductive material onto the dielectric thin film sheet by means of electrostatic bonding and then etching, it is possible to form a dielectric thin film sheet with the first electrodes attached thereto. A structure comprising the first substrate, first electrodes and the dielectric layer covering these can be achieved simply by laminating or attaching the first substrate to the thin film sheet.

Moreover, in the present invention, the step of laminating or attaching the dielectric thin film sheet and the first substrate is carried out by introducing a dielectric material in liquid form between them. By so doing, the dielectric material in liquid form penetrates in between the first substrate and the dielectric thin film sheet, thereby enabling a structure wherein no air spaces are formed between the first electrodes fabricated therebetween.

Furthermore, in the present invention, a spacer of a prescribed thickness is inserted between the dielectric thin film sheet and the second substrate, in the perimeter region thereof, when they are sealed such that a discharge space is provided therebetween. Since the dielectric thin film sheet itself is extremely thin, it can be expected that the perimeter regions of the thin film sheet may warp and be damaged when the dielectric thin film sheet and the second substrate are sealed, due to the second electrodes and rib structure formed in the central portion of the second substrate. Therefore, this problem of warping and damaging is resolved by providing a spacer of a prescribed thickness in this perimeter region.

BRIEF DESCRIPTION OF THE DRAWINGS

FIGS. 2A–2I show sectional views describing a first example of a manufacturing process for the PDP in FIG. 1;

FIGS. 13A–13I show sectional views illustrating a modification of the first manufacturing process shown in FIG. 2;

DESCRIPTION OF THE PREFERRED EMBODIMENT

Below, an example of a mode for implementing the present invention is described with reference to the drawings. However, this mode of implementation does not limit the technical scope of the present invention. Furthermore, this mode of implementation is described with reference to a three-electrode surface discharge AC-type PDP, but the present invention is not limited to this structure.

Figure 1:
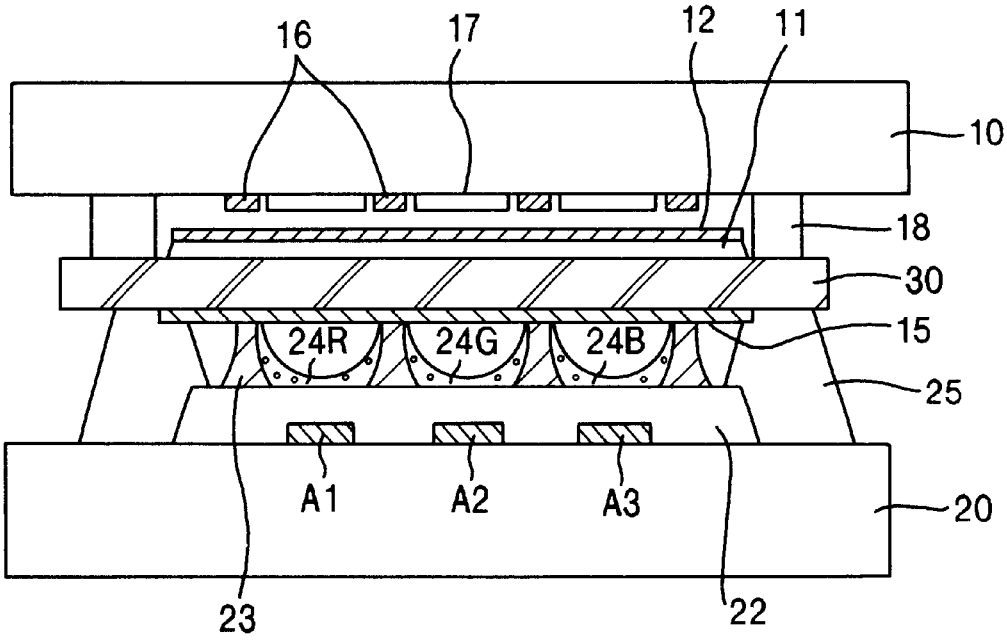
FIG. 1 is a sectional view of a PDP according to a mode for implementing the present invention.

FIG. 1 is a sectional view of a PDP in a mode for implementing the present invention. In this example, a dielectric thin film sheet 30, such as a micro-sheet, or the like, is used as a dielectric layer inserted between transparent electrodes 11 and corresponding bus electrodes 12 constituting display electrode pairs and a discharge space. A protective layer 15 made from MgO, or the like, is formed by vapor deposition onto the discharge space side of the micro-sheet 30. The micro-sheet 30 and a rear-side glass substrate 20 are sealed together by a sealing material 25 consisting of low-melting-point glass.

Reinforced glass compressed at high temperature is used for the display-side substrate 10, and on the inner side thereof, black strip layers 16 are formed in matching positions to the ribs 23 and colour filters 17 are formed to match the pattern of the three colour fluorescent layers 24R, 24G, 24B. The display-side reinforced glass substrate 10 and the micro-sheet 30 are bonded or laminated together by a prescribed adhesive 18 or they are electrostatically bonded.

Here, the micro-sheet 30 is a thin dielectric sheet comprising of borosilicate glass, or the like, including silicon dioxide ($SiO_2$) and boron trioxide ($B_2O_3$), for example, as principal components. The sheet thickness is of the order of 30 $\mu$m and approximately 50 $\mu$m at maximum. A micro-sheet 30 of this kind is used widely as a sheet in liquid crystal displays, or the like, and it is known to have high thermal resistance and low expansivity.

By adopting the aforementioned structure, the following advantages can be expected. Firstly, by using a micro-sheet 30, it is possible to eliminate the complicated manufacturing process for forming a dielectric layer involved in the prior art. Furthermore, since the micro-sheet 30 and rear-side glass substrate 20 can be sealed by means of a sealing material 25 comprising low-melting-point glass etc., the display-side glass substrate 10 is not subjected to a high-temperature state during the manufacturing process. Therefore, reinforced glass, which is unsuitable for high-temperature processing, can be used for the glass substrate on the display side, and hence it is unnecessary to apply a reinforced glass substrate separately after sealing. Consequently, it is possible to reduce costs significantly and also to reduce the weight of the PDP. Moreover, since the display-side glass substrate 10 is not subjected to high-temperature processing, it is possible to use organic materials which have poor resistance to high temperatures in the black strip layers 16 and colour filter layers 17, and hence the manufacturing costs for these can be greatly reduced. These advantages can be understood clearly from the manufacturing process described below.

FIG. 2 shows sectional views describing a first example of a manufacturing process for the PDP in FIG. 1. In this manufacturing process, display electrodes pairs 11, 12 and a protective layer 15 of MgO, or the like, are previously formed onto either side of a micro-sheet 30, and this micro-sheet 30 is sealed by a sealing material 25 together with a rear-side glass substrate 20, whereon address electrodes, ribs, fluorescent layers, etc. are fabricated, such that a discharge space is formed therebetween, and finally, a reinforced glass substrate 10 is laminated thereto as a display-side substrate.

FIGS. 2(*a*)–(*c*) illustrates processes of fabrication onto the micro-sheet 30. The micro-sheet is usually transported in the form of a roll, and transparent electrodes 11 made from ITO (indium oxide $In_2O_3$ and tin oxide $SnO_2$ semiconductor,) or the like, are formed to a thickness of approximately 0.2 $\mu$m by subjecting the micro-sheet in a rolled state to a general sputtering method, etc. in a vacuum atmosphere. A standard lithography technique is used for patterning. Since the dielectric electrodes 11 themselves have low conductivity, bus electrodes 12 having a chrome/copper/chrome (Cr/Cu/Cr) three-layer structure are formed similarly by sputtering and lithography techniques onto the end portions of the transparent electrodes 11, as shown in FIG. 2(*b*), in order to maintain conductivity. The thickness of this three-layer structure is, in order, 0.1 $\mu$m, 0.2 $\mu$m, 0.1 $\mu$m, for example. The lower chrome layer serves to ensure adhesion with the ITO. The upper chrome layer conventionally serves to prevent diffusion into the dielectric layer, and in the present mode of implementation, it may not be necessary in some cases. A magnesium oxide (MgO) film is formed by vapor deposition to a thickness of approximately 0.5 $\mu$m onto the opposite side of the micro-sheet 30 to act as a protective layer.

In the steps in FIGS. 2(*a*)–(*c*), themicro-sheet can be processed in a rolled state, and these steps are suitable for mass production. A display electrode pair and a protective layer are formed onto either side of the roll-shaped micro-sheet, and finally, it is cut into pieces of the size of panels. In this process, since the micro-sheet itself has thermal resistance, no particular problem arises if it is subjected to a high temperature of 350° C., for example, which is required in the vapor deposition process for the protective layer. Furthermore, the display electrode pairs can be formed by laminating a micro-sheet to a metal foil sheet (described below) by electrostatic bonding. By using this method, time-consuming sputtering processes can be eliminated and the fabrication process can be shortened.

FIGS. 2(*d*)–(*g*) illustrate fabrication processes onto the rear-side substrate. In the present mode of implementation, these fabrication processes on the rear-side substrate are similar to conventional fabrication processes. Namely, a glass substrate 20 is taken as an insulating substrate, and address electrodes A1–A3 are formed thereon in a chrome/copper/chrome triple-layer structure. This triple-layer structure is formed by sputtering, as described above, followed by lithography.

As shown in FIG. 2(*e*), a dielectric layer 22 is formed onto the glass substrate 20 and address electrodes A. This dielectric layer 22 is fabricated by forming low-melting-point glass granules comprising lead oxide (PbO) as a principal component into a paste, coating this paste by screen printing, and then annealing for 30 minutes in a 600° C. annealing atmosphere. Moreover, as shown in FIG. 2(*f*), the low-melting-point glass paste is printed thickly and is patterned by sand-blasting. As a result, ribs 23 forming partitions are fabricated in positions on either side of the respective address electrodes. RGB fluorescent layers 24, for example, are then formed between the ribs 23.

Next, the micro-sheet 30 and the rear-side glass substrate 20 are sealed together, as shown in FIG. 2(*h*). This sealing is carried out by forming a sealing material 25, comprising a paste of low-melting-point glass, such as PbO, etc., onto the perimeter of the micro-sheet 30 surface whereon the protective layer 15 is fabricated, laminating the rear-side substrate 20 and then subjecting the composition to an annealing temperature of 400° C., or the like. In this sealing process, the low-melting-point glass ribs 23 and the micro-sheet 30 are also bonded. FIGS. 2(*h*) and (*i*) show a state where the display electrodes 11, 12 are rotated through 90° for the sake of convenience.

As shown in FIG. 2(*i*), finally, a display-side glass substrate 10 made from reinforced glass is attached to the surface of the micro-sheet 30 on which the display electrodes pairs are fabricated. This application process is conducted at room temperature, or a relatively low temperature. For example, it is conducted by electrostatic bonding (described below), wherein a voltage is applied between the micro-sheet 30 and the glass substrate 10. Alternatively, it may also be conducted by a bonding method at the glass transition temperature (described below). In this case, although omitted from FIG. 2(*i*), black strip layer 16 and colour filters 17 are previously formed onto the surface of the glass substrate 10. Since the glass substrate 10 is not subjected to high-temperature processing, these black strip layers 16 and colour filters 17 can be formed using organic materials, for example. For these organic materials, a mixture of a resist material with a prescribed pigment is used, for example, so that the material can be formed to a prescribed pattern simply by exposing and developing.

Figure 3A:
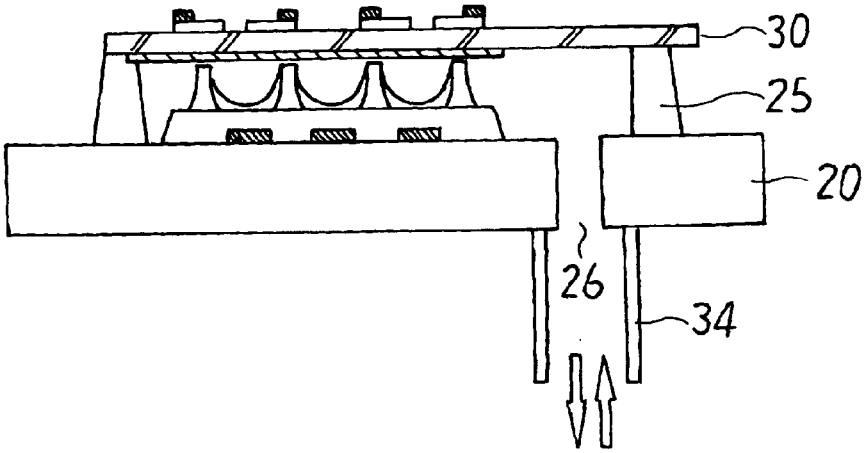
FIGS. 3A–3B show sectional views illustrating the processes in FIGS. 2(*h*) and (*i*) in more detail.
Figure 3B:
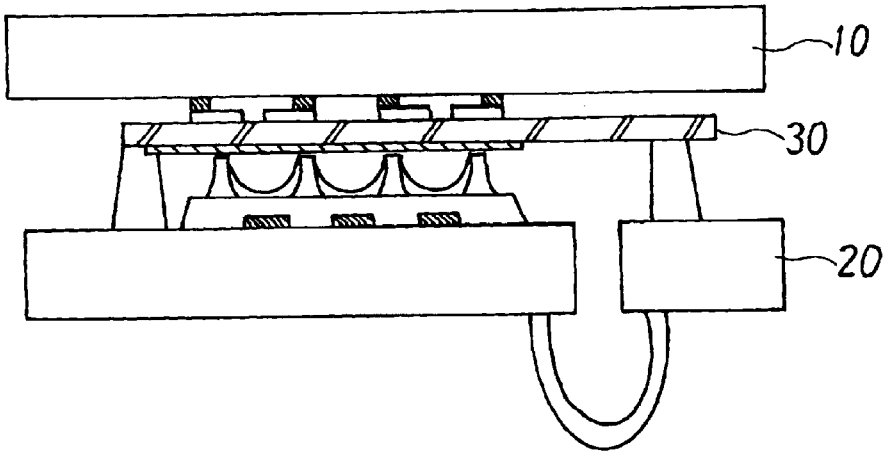

FIG. 3 shows sectional views illustrating the steps in FIGS. 2(*h*) and (*i*) in more detail. Here also, a state where the display electrodes pairs 11, 12 are rotated through 90° is depicted. As shown in FIG. 3(*a*), after sealing the micro-sheet 30 and the glass substrate 20 together by means of a sealing material 25 made from low-melting-point glass, the temperature is raised and gas is expelled via a hole 26 formed in the glass substrate 20, whereupon, a discharge gas of Ne+Xe, etc. is introduced and the hole 26 is sealed. This expelling of the gas removes moisture, carbon dioxide, and the like, adsorbed into the surface of the protective layer 15 by vaporization.

As shown in FIG. 3(*b*), the display-side glass substrate 10 made from reinforced glass is bonded or laminated to the micro-sheet 30 in the assembled micro-sheet 30 and rear-side substrate 20 containing discharge gas. This bonding or lamination can be conducted by electrostatic bonding at room temperature. In other words, by applying a prescribed voltage between the micro-sheet 30 and the rear-side glass substrate 20, the temperature at the interface therebetween is raised. Consequently, a chemical reaction is produced between the glass substrate 10 and the electrodes 12, and they bond together.

A further bonding method involves applying a press from both sides whilst heating to a temperature above the glass transition temperature of the reinforced glass substrate 10. The glass transition temperature is the temperature at which the glass starts to soften slightly (430° C.) and it is lower than the glass softening temperature (450° C.). The glass substrate 10 and the micro-sheet 30 are bonded without any gap therebetween by raising them to this temperature. At a low temperature of this kind, there is no loss of the compressed state of the reinforced glass which is formed by compression at 600° C. Besides using a hot press at the glass transition temperature, the bonding process can also be carried out by using a suitable adhesive. As shown in FIG. 1, the adhesive may be provided only in the perimeter regions of the substrate, in which case, desirably, silicon oil, or the like, is filled into the gap between the substrate and micro-sheet. In either of the processes, there is no loss of the compressed state of the glass substrate 10, which is made from reinforced glass.

According to the first example of a manufacturing process described above, it is not necessary to form a dielectric layer onto the display-side glass substrate by printing and annealing. Furthermore, since the display-side glass substrate is not subjected to high-temperature processing, reinforced glass can be used. Therefore, manufacturing costs can be reduced, the manufacturing process can be shortened, and further cost reductions and weight reductions can be achieved by decreasing the number of sheets of glass substrate.

Figures 4E, 4F, 4G, 4H:
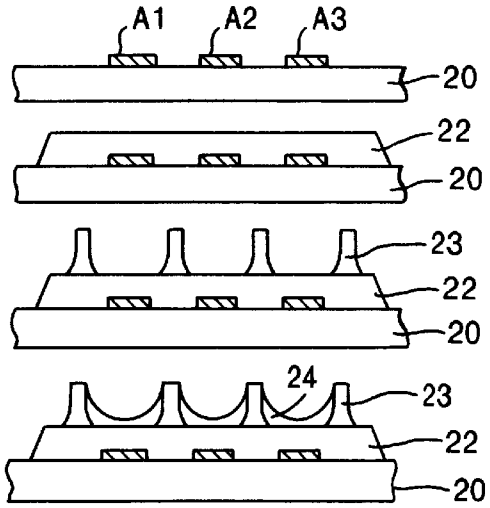
FIGS. 4A–4I show sectional views illustrating an example of a second manufacturing process.
Figures 4A, 4B, 4C, 4D:
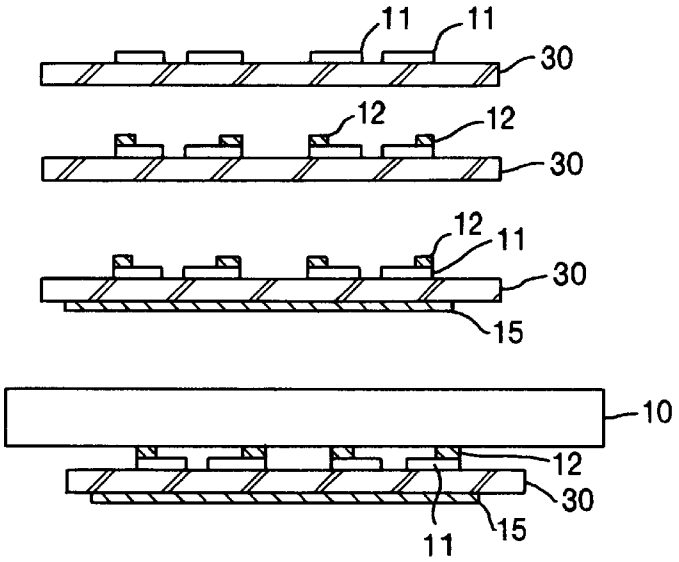
Figure 4I:
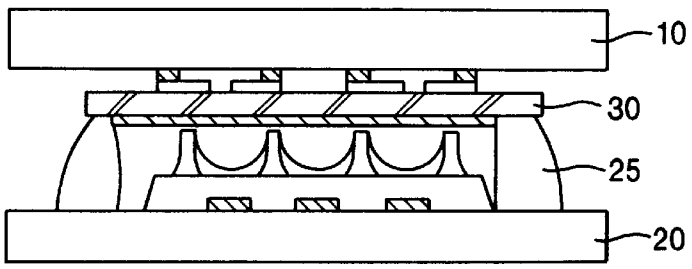

FIG. 4 shows sectional views illustrating a second example of a manufacturing process. In this example, the process of forming display electrode pairs 11, 12 and a protective layer 15 onto a micro-sheet 30 is the same as in the first example described above. However, the display-side glass substrate 10 is laminated to the micro-sheet 30 and the rear-side glass substrate 20 is bonded thereto.

FIGS. 4(*a*)–(*c*) are the same as FIGS. 2(*a*)–(*c*). Display electrode pairs 11, 12 and a protective layer 15 are formed onto either side of a roll-shaped micro-sheet 30 by sputtering and vapor deposition, respectively. Accordingly, there is no process of printing and annealing for forming the dielectric layer, as in the prior art. As shown in FIG. 4(*d*), the micro-sheet 30 is bonded or laminated to the display-side glass substrate 10 by electrostatic bonding or by processing at the glass transition temperature, as described above. Black strip layers and colour filter layers (omitted from diagram) are previously formed onto the display-side glass substrate 10.

FIGS. 4(*e*)–(*h*) illustrate fabrication processes onto the rear-side glass substrate 20, and these are the same processes as in FIGS. 2(*d*)–(*g*).

Finally, as shown in FIG. 4(*j*), the display-side glass substrate 10, to which the micro-sheet 30 is laminated, and the rear-side glass substrate 20 are sealed in an atmosphere of approximately 400° C. by means of a sealing material 25 made from low-melting-point glass. In this process, the sealing material 25 may be provided between the rear-side glass substrate 20 and the micro-sheet 30, or it may be provided between the rear-side and display-side glass substrates 10, 20.

In this process example, similarly to the first example described above, the fabrication process for the dielectric layer on the display-side glass substrate 10 can be eliminated and replaced by laminating of a micro-sheet.

Figures 5A, 5B, 5C, 5D, 5E, 5F, 5G, 5H, 5I:
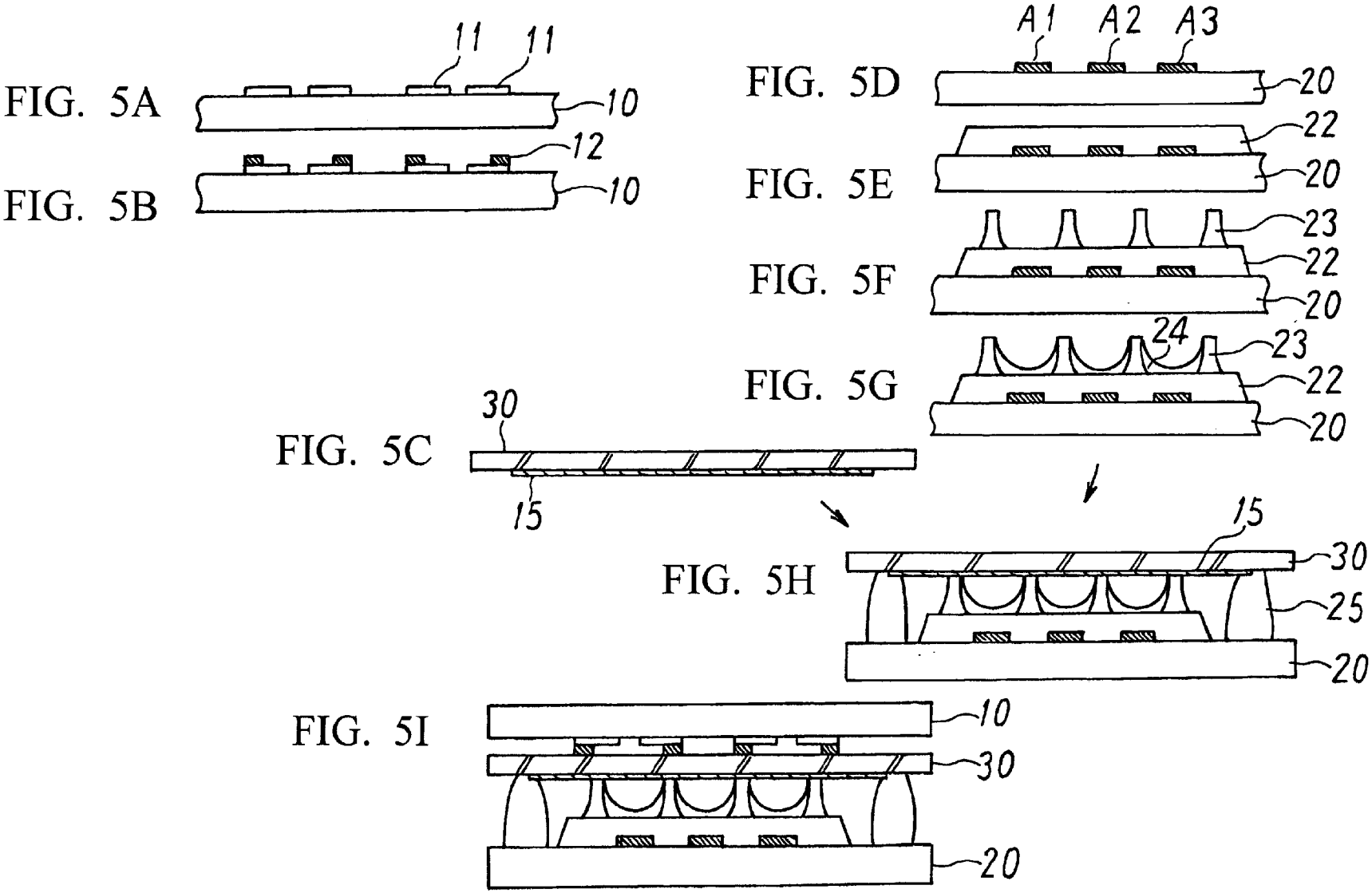
FIGS. 5A–5I show sectional views illustrating an example of a third manufacturing process.

FIG. 5 shows a third example of a manufacturing process. In this example, display electrode pairs 11, 12 are formed onto the display-side glass substrate 10, and a micro-sheet 30 is used as the dielectric layer. Therefore, the processes of printing and annealing a dielectric layer are unnecessary. But in the final complete structure, the composition of the display electrode pairs is different to that in FIG. 1. Furthermore, in this sectional diagram, the display electrode pairs are shown rotated through 90°.

In FIGS. 5(*a*) and (*b*), transparent electrodes 11 and bus electrodes 12 are formed onto a display-side substrate 10 by means of sputtering, and vapor deposition and lithography, respectively. The bus electrodes 12 may be formed by, for example, laminating copper foil onto the transparent electrodes 11, and then bonding by ion reaction at the interface between the glass substrate 10 and the copper foil by means of electrostatic bonding which involves applying a voltage between the copper foil and the glass substrate 10. Bonding by chemical reaction is completed by means of the oxygen ions in the glass substrate 10 moving to the copper foil to form an oxide of copper at the interface, when the voltage is applied. In this case, the lower chrome layer is unnecessary since the bus electrodes 12 are not required to have adhesive properties, and the upper chrome layer is also unnecessary since there are no problems of dispersion with the dielectric layer. Therefore, the bus electrodes 12 are formed from copper foil alone.

After forming the copper foil by electrostatic bonding, it is etched to a prescribed pattern by a standard lithography technique. The formation of copper foil electrodes is described in more detail below.

FIG. 5(*c*) is a sectional view of a fabrication process onto a micro-sheet 30. A protective layer 15 is formed onto the micro-sheet 30 by vapor deposition. FIGS. 5(*d*)–(*g*) are fabrication processes onto the rear-side glass substrate 20, and they are the same as the fabrication processes in FIGS. 2(*d*)–(*g*).

As shown in FIG. 5(*h*), the rear-side glass substrate 20 and the micro-sheet 30 onto which the protective layer 15 is formed are sealed together by means of a sealing material 25 made from a low-melting-point glass. Thereupon, a discharge gas is introduced into the gap therebetween, which is then sealed, as illustrated in FIG. 3.

Finally, as shown in FIG. 5(*i*), the display-side glass substrate 10, onto which the display electrode pairs are formed, is attached onto the micro-sheet 30. This laminating process may be conducted using a prescribed adhesive, or it may be carried out by bonding at the glass transition temperature or by electrostatic bonding, as described above.

Figures 6A, 6B, 6C, 6D, 6E, 6F, 6G, 6H, 6I:
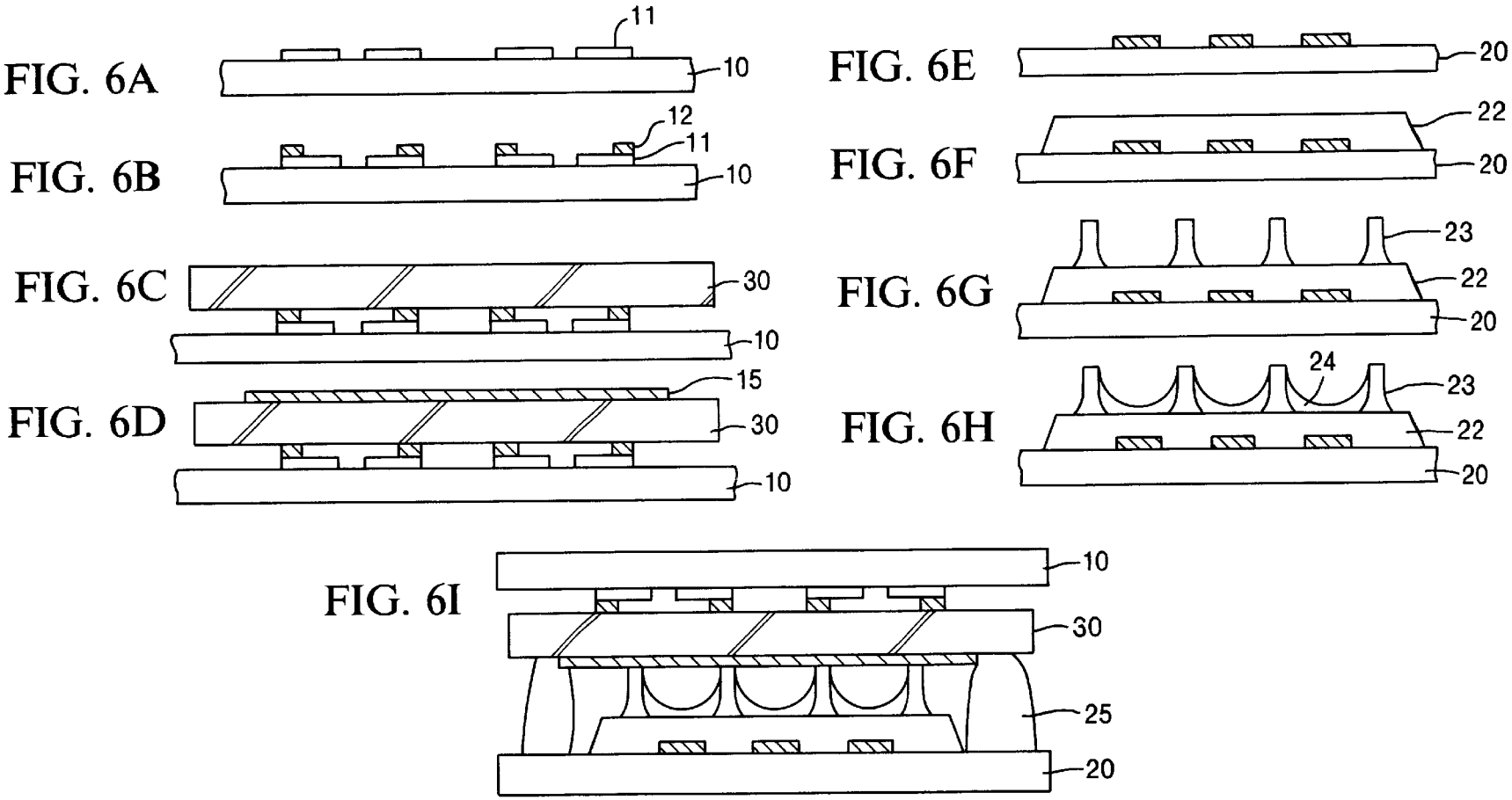
FIGS. 6A–6I show sectional views illustrating an example of a fourth manufacturing process.
Figure 7A:
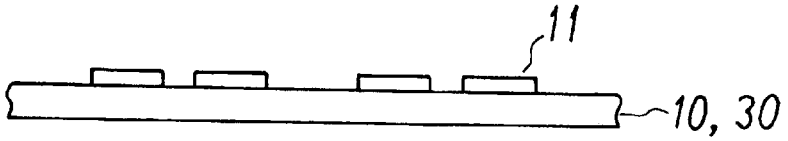
FIGS. 7A–7D show sectional views illustrating a further process for forming bus electrodes or address electrodes onto a micro-sheet or glass substrate.
Figure 7B:
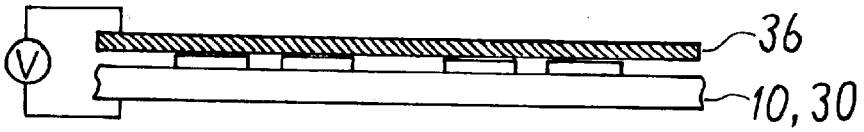
Figure 7C:
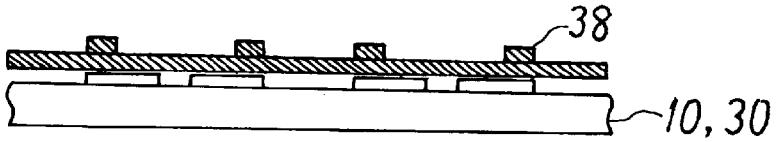
Figure 7D:
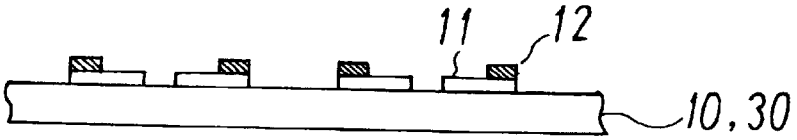
Figure 8:
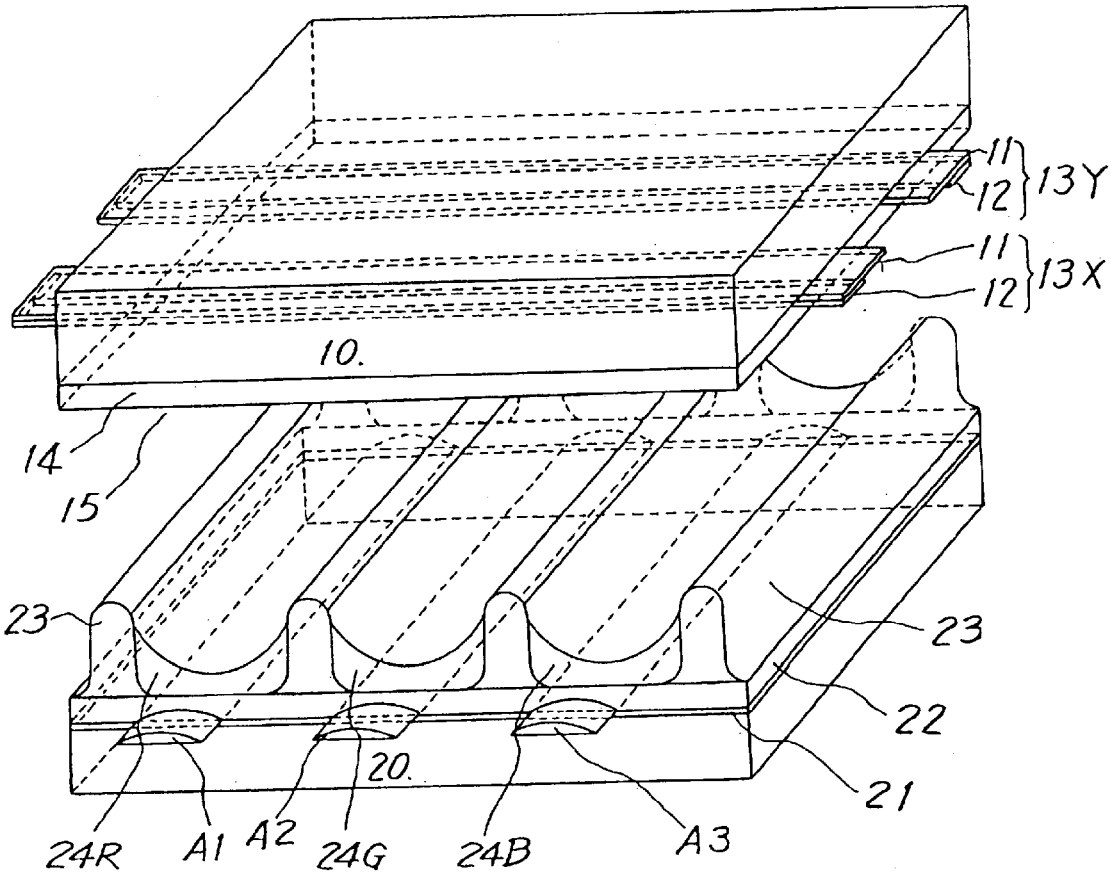
FIG. 8 is a general oblique dissembled view of a PDP.
Figures 9A, 9B, 9C, 9D, 9E, 9F, 9G, 9H, 9I:
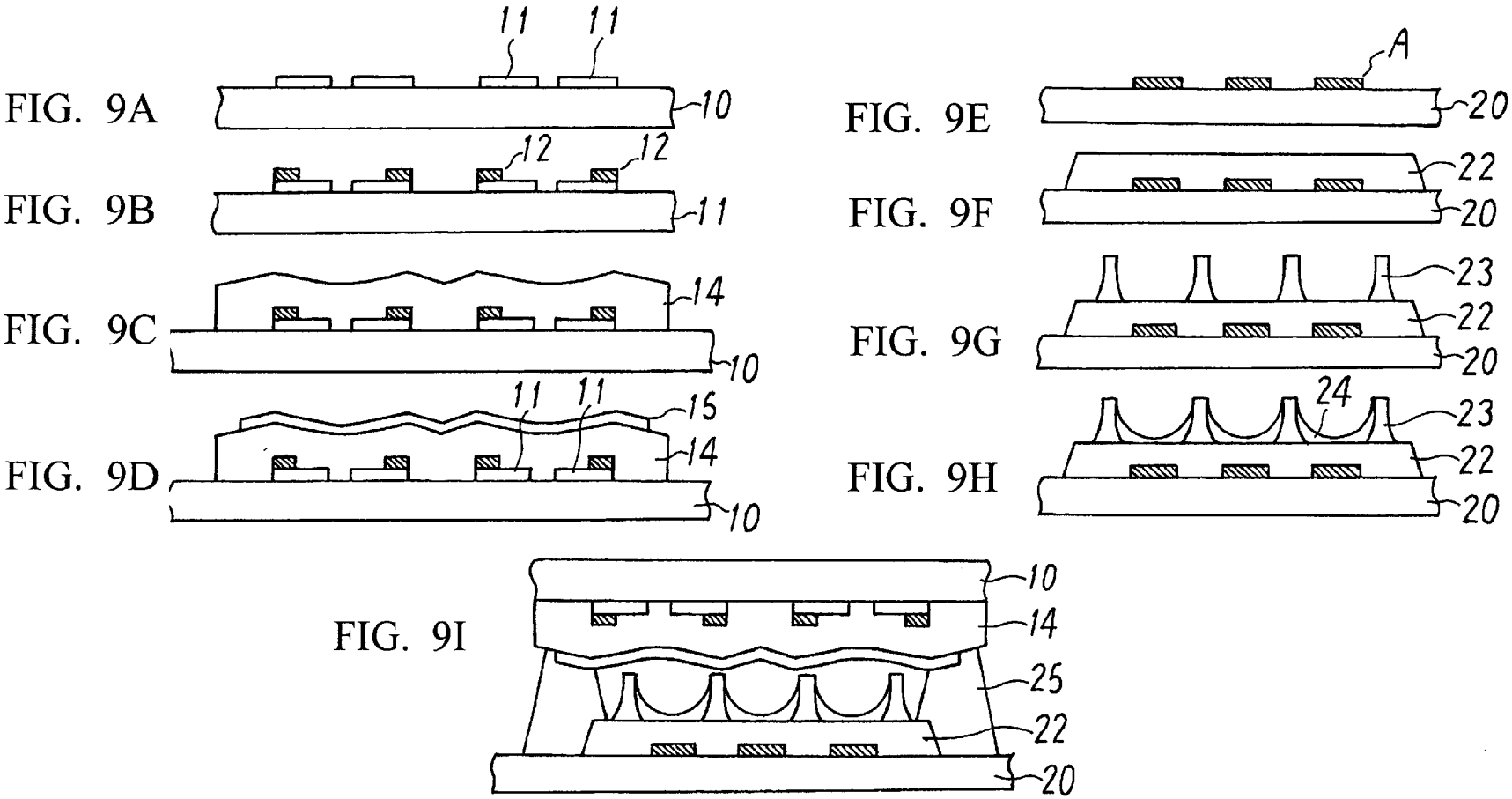
FIGS. 9A–9I show sectional views illustrating an approximate manufacturing process for the PDP in FIG. 8.

FIG. 6 shows sectional views illustrating a fourth example of a manufacturing process. This example has the same sequence of steps as the prior art example shown in FIG. 9, but instead of a printing and annealing process for the dielectric layer, a micro-sheet 30, which is a thin film sheet of dielectric material, is laminated.

FIGS. 6(*a*)–(*d*) shows fabrication processes onto the display-side glass substrate. Transparent electrodes 11 and bus electrodes 12 are formed onto a glass substrate. The forming method for this is as described previously. A micro-sheet 30 is then laminated onto the display electrode pairs. This laminating process is carried out, for example, by electrostatic bonding or by bonding at the glass transition temperature. Thereupon, a protective layer 15 of magnesium oxide is formed onto the surface of the microsheet 30 by vapor deposition.

FIGS. 6(*e*)–(*h*) shows fabrication processes onto the rear-side glass substrate, and these are the same as the processes illustrated in FIGS. 2(*d*)–(*g*) above. As shown in FIG. 6(*i*), finally, the display-side glass substrate 10 and the rear-side glass substrate 20 are sealed by a sealing material 25.

According to the aforementioned process, printing and annealing processes for forming a dielectric layer onto the display-side glass substrate 10 are not necessary, and therefore these time-consuming and complicated printing and annealing processes can be omitted.

FIG. 7 shows sectional views illustrating a further process for forming bus electrodes or address electrodes of copper etc. onto a micro-sheet or glass substrate. In this example, display electrode pairs are formed onto the display-side glass substrate 10 or the micro-sheet 30.

Firstly, as shown in FIG. 7(*a*), transparent electrodes 11 are formed onto the glass substrate 10 or micro-sheet 30 by sputtering and lithography. Metal foil 36 made from copper foil or the like approximately 2–10 μm thick is applied thereto, as shown in FIG. 7(*b*). Electrostatic bonding as described above is suitable for laminating the foil. In other words, the two elements are bonded together by raising the temperature at the interface by applying a voltage therebetween, thereby causing the oxygen ions in the glass substrate to disperse into and react with the metal foil. In order to simplify the electrostatic bonding process, desirably, the metal foil 36 comprises a thin sheet of silicon, chrome, molybdenum, tantalum, nickel, tungsten, cobalt, titanium, or the like, formed on the surface thereof.

Thereupon, as illustrated in FIG. 7(*c*), a mask film 38 is formed by forming a resist layer and patterning by means of lithography. The element is then immersed in a prescribed etching solution, and the copper foil 36 in the regions where the mask film 38 is not formed is removed, as shown in FIG. 7(*d*).

This electrode formation process using metal foil can also be used for forming the address electrodes. Therefore, by using this method, time-consuming processes using sputtering can be omitted.

In the mode of implementation described above, an example wherein reinforced glass is used for the display-side substrate is described, but it is also possible to use a reinforced plastic. The rear-side glass substrate 20 was described as a glass substrate, but a different insulating substrate may also be used. Furthermore, in the description, the dielectric layer 22 is formed onto the rear-side glass substrate by a printing and annealing process as described previously, but it is also possible to adopt a method where a micro-sheet is laminated instead of this dielectric sheet 22.

Liquid-form Dielectric Material and Spacer

In the mode of implementation described above, a case was described where a micro-sheet, which is a dielectric thin film sheet, was used as the dielectric layer between the discharge space and the X, Y electrodes. However, using this micro-sheet, as shown in FIG. 1, FIG. 2(*i*), FIG. 4(*j*), FIG. 5(*i*) and FIG. 6(*i*), a space which does not contain a dielectric layer is formed between the X, Y electrodes comprising the transparent electrodes 11 and the bus electrodes 12. Since the X, Y electrodes 11, 12 formed onto the micro-sheet 30 or the display-side substrate 10 have a film thickness of approximately 2–3 μm, undulations are formed by the electrodes. Since the micro-sheet is, for example, a thin sheet of uniform stiffness made from glass, it cannot cover the electrodes completely following the undulating shape thereof. The spaces formed by the undulations between the electrodes have an atmosphere containing air, a vacuum, a discharge gas, or the like, depending on the aforementioned embodiment. Therefore, if a discharge voltage is applied between the X, Y electrodes during a sustain discharge, for example, a discharge may be generated in these spaces. Since the electrodes 11, 12 are exposed in these spaces, once discharge has started, the electrodes vaporize due to the heat generated by discharge, thereby generating a conductive vapor. The presence of this conductive vapor induces a continuous discharge, and in some cases, ultimately an arc discharge is achieved wherein successive discharges are produced whilst the point of discharge moves.

Therefore, in a modification of the present invention, in the step of laminating the display-side substrate to the micro-sheet, which is a dielectric thin film sheet, a dielectric material in liquid form, such as silicon oil, is inserted therebetween, such that the spaces in the undulations formed by the electrodes are filled completely with dielectric material. By filling the spaces between the electrodes with dielectric material in this way to raise the dielectric constant, occurrence of arc discharges between the electrodes during sustain discharge, as described above, can be prevented.

Moreover, in the present invention, the discharge space between the micro-sheet 30, which is a dielectric thin film sheet, and the rear-side substrate 20 is sealed by means of high-temperature annealing, as illustrated in FIG. 2(*h*) and FIG. 5(*h*). In this case, pressure is applied to the whole surface of the micro-sheet 30 during the annealing process, in order that the thin film micro-sheet 30 does not deform under the high annealing temperature, and also to ensure good sealing. However, as shown in these diagrams, ribs 23 for separating the address electrodes A1, A2, A3 are formed onto the rear-side substrate 20. These ribs are relatively thick at 100–20 $\mu$m, and are formed on the rear-side substrate 20 with the exception of the perimeter region thereof. Therefore, when a micro-sheet is superimposed on the rear-side substrate 20, whereon ribs 23 have been formed, and the elements are sealed by melting a glass sealing material at the perimeter region thereof at high temperature whilst applying pressure, warping is produced at the perimeter region of the micro-sheet due to the thickness of the ribs 23. The micro-sheet 30 may be damaged by this warping. In particular, in the annealing process for the glass sealing material, as described above, it is necessary to apply pressure to the perimeter region between the micro-sheet 30 and the rear-side glass substrate 20, and this pressure will damage the micro-sheet.

Therefore, in the present invention, a spacer material of approximately the same thickness as the ribs 23 is provided in the perimeter region between the micro-sheet and the rear-side substrate, before the two elements are superimposed and sealed. For example, a member similar to the ribs 23 may be appended as a spacer to the perimeter region of the rear-side substrate 20. This composition can be achieved simply without additional processing steps by forming ribs on the perimeter region of the substrate 20 when forming the ribs 23.

Alternatively, it is also possible to use glass beads or a frame made from a special spacer material. By appending a spacer, it is possible to prevent distortion and damage in the perimeter region of the micro-sheet.

Figure 10:
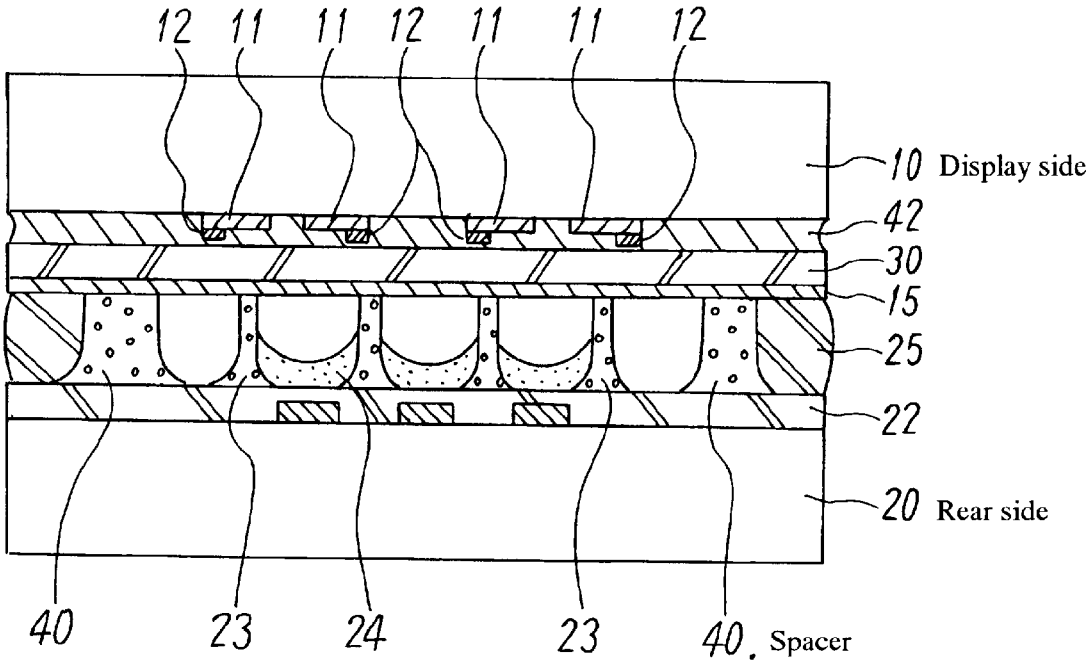
FIG. 10 is a sectional view showing a case where a liquid dielectric material and a spacer are provided in the third manufacturing method illustrated in FIG. 5.

FIG. 10 is a sectional view of a case where a liquid dielectric material and a spacer are provided in the third manufacturing method illustrated in FIG. 5. In this diagram, to aid understanding, the X, Y electrodes 11, 12 are shown rotated through 90°. In reality, they are located parallel to the paper surface.

In the example in FIG. 10, a dielectric material 42 in liquid form is provided between the display-side substrate 10 and the micro-sheet 30. In specific terms, X, Y electrodes 11, 12 are formed onto the display-side substrate 10, and a predetermined quantity of a liquid dielectric material, such as silicon oil or the like, is coated by a dispenser method (method whereby the liquid is coated from a thin tube, such as a syringe) onto a particular location on the display-side glass substrate 10 such that it intersects with the electrodes 11, 12. For example, silicon oil having a viscosity of 450 cp, or the like. is coated onto the central region of the substrate 10, and the display-side glass substrate 10 and the micro-sheet 30 are laminated together.

Silicon oil has good wetting properties with respect to a glass surface, and therefore, when it is inserted between the display-side substrate 10 and the glass micro-sheet 30, it spreads by capillary action into the spaces between the X, Y electrodes. By coating a suitable surface area of the central region of the substrate with the required quantity of silicon oil by means of a dispenser method, the whole surface of the substrate can be covered uniformly, without the oil overflowing from the edges of the substrate. After applying a specific quantity of silicon oil, the substrate 10 and the micro-sheet 30 are superimposed on each other, and a weight of a certain mass is used to apply pressure to the whole surface, thereby causing the silicon oil to cover the whole surface uniformly.

Apart from silicon oil, it is also possible to use a silicon gum, epoxy resin, UV-setting resin, anaerobic adhesive, or a thermoplastic resin, such as polycarbonate, as the liquid dielectric material. These resins range from those that harden at room temperature, to those that harden at a high temperature of about 150° C., to those that harden under ultraviolet light. Since these resins in liquid form have an even more uniform viscosity than the silicon oil, they coat evenly onto the whole surface of the substrate 10. Thereupon, the display-side substrate and the micro-sheet are laminated on each other, and by applying a roller to the whole of the laminated substrate and micro-sheet, air trapped during the coating process can be expelled completely from the space between the two elements. If one of the aforementioned resins is used, it is then hardened and the two elements become bonded together strongly. When the roller is applied in this way, the flexible micro-sheet transmits the pressure from the roller to the spaces in the recess regions, thereby pressing on these spaces and expelling any air bubbles from the substrate. Furthermore, as a method for forming the dielectric material, it is also possible to heat a thermoplastic resin, such as polycarbonate, to its melting point or above, whilst coating it onto the substrate 10 such that its film thickness is the same at the electrodes, whereupon the resin is hardened, thereby forming a flat substrate surface, onto which the micro-sheet 30 is then laminated.

Figure 11:
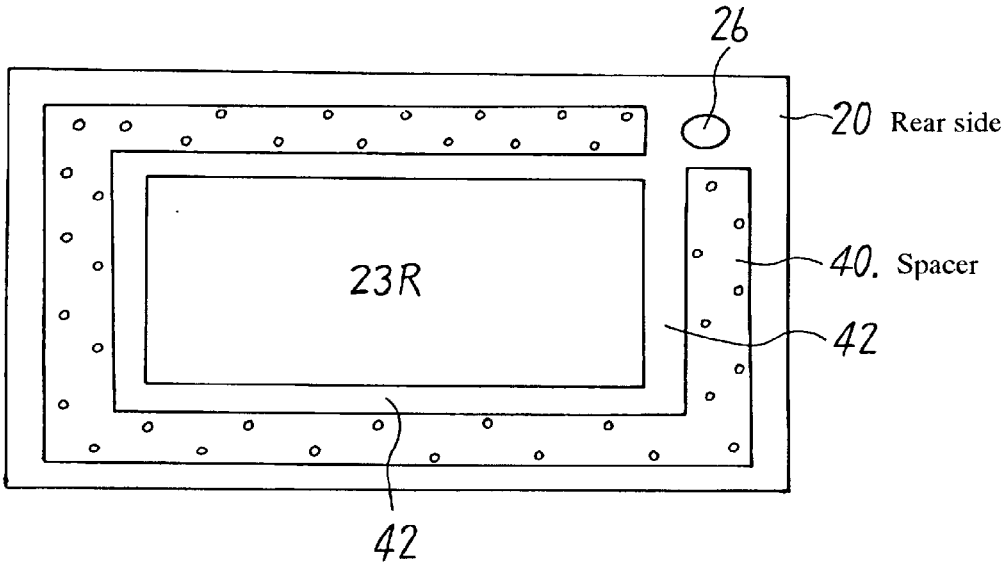
FIG. 11 is a plan view of a rear-side substrate 20 provided with the spacer 40 in FIG. 10.

In the example shown in FIG. 10, the micro-sheet 30 and the rear-side substrate 20 are sealed by means of a sealing material 25, and a spacer 40 of a similar thickness to the ribs 23 is provided in the perimeter region of the rear-side substrate 20. FIG. 11 is a plan view of a rear-side substrate 20 provided with a spacer 40. A plurality of ribs 23 are formed in a compact configuration in the display region 23R in the centre of the rear-side substrate 20. In the example in FIG. 11, a spacer 40 is provided around the perimeter of this display region. The spacer 40 is separated from the rib region 23R by an interval 42. No spacer 40 is provided in the region of the hole 26 for inserting discharge gas.

In other words, after sealing, the discharge gas is introduced from the hole 26 into the rib region 23R via the interval 42. The spacer 40 is made from the same low-melting-point glass as the ribs 23, and is fabricated simultaneously in the process of forming the ribs 23. Alternatively, the spacer 40 can be formed by dispersing glass beads of even diameter in a solvent, and coating this onto the perimeter region of the rear-side substrate 20. Alternatively, thin sheet glass, glass fibres, resin sheet, or a thin sheet of high-melting-point metal, e.g. nickel, can be used as a spacer by forming it into the shape of element 40 in FIG. 11.

Figure 12:
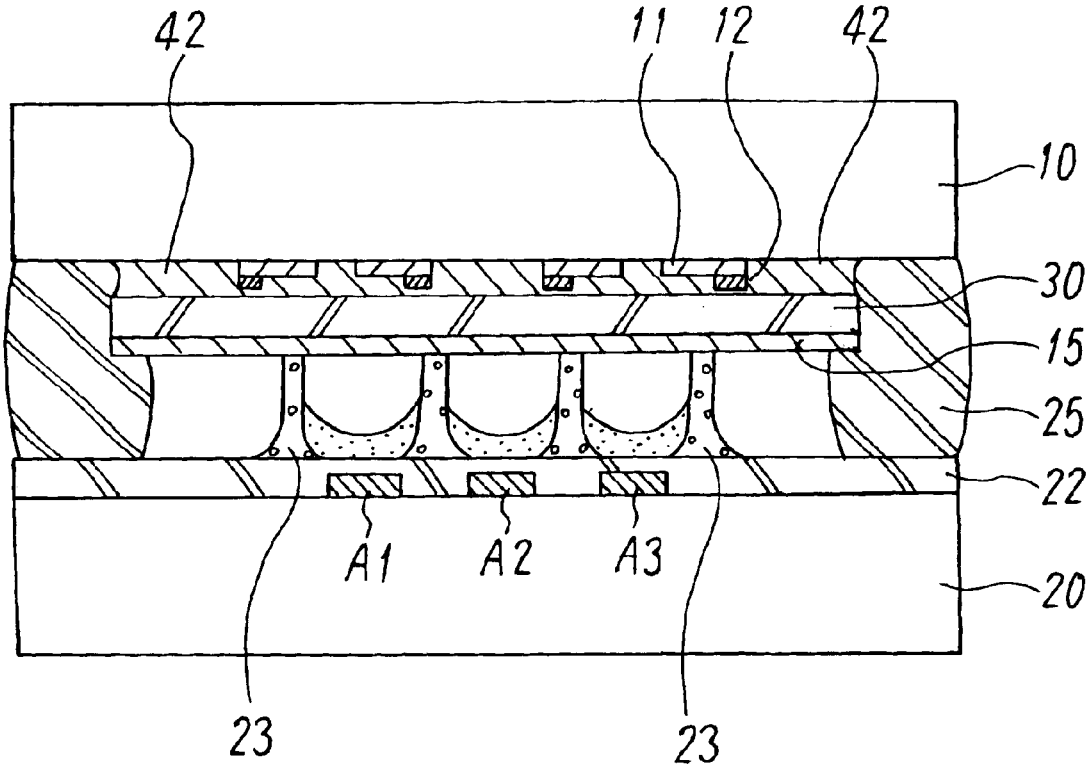
FIG. 12 is a sectional view showing a case where a liquid dielectric material 42 is used in the second or fourth manufacturing processes described in FIG. 4 or FIG. 6.

FIG. 12 is a sectional view of a case where a liquid dielectric material 42 is used in the second or fourth manufacturing processes described in FIG. 4 or FIG. 6. In this example, when the display-side substrate 10 and the micro-sheet 30 are laminated and bonded together, a liquid dielectric material 42, such as silicon oil, is inserted therebetween, and the display-side substrate 10 and the rear-side substrate 20 are then sealed using a sealing material 25. In this case, silicon oil is present in a liquid state between the display-side substrate 10 and the micro-sheet 30, and there is the risk that the volatile component of the silicon oil may enter into the discharge gas space and degrade discharge properties. Therefore, in the example in FIG. 12, the silicon oil 42 is sealed at the edges of the micro-sheet 30 by a sealing material 25, thereby separating it from the discharge gas space. The edges of the micro-sheet 30 may be sealed by a prescribed sealing material separate from the sealing material 25.

FIG. 13 shows sectional views illustrating a modification of the first manufacturing process shown in FIG. 2. FIGS. 13(*a*)–(*c*) are the same as in FIG. 2. In these steps, transparent electrodes 11 and bus electrodes 12 are formed onto one surface of a micro-sheet 20 30, and a protective layer 15 of MgO, or the like, is formed onto the other surface thereof. The processes relating to the rear-side substrate 20 illustrated in FIGS. 13(*d*), (*e*) are the same as in FIG. 2. Namely, address electrodes A1–A3 are formed onto the rear-side substrate 20. Thereupon, a dielectric layer 22 of low-melting-point glass having lead oxide as a principal component is formed thereon.

FIG. 13(*f*) shows a process which differs from that in FIG. 2. In the process in FIG. 13(*f*), when a low-melting-point glass paste is printed thickly onto the whole surface and is then patterned by sand-blasting, in addition to leaving portions for the ribs 23, a spacer 40 is also left in the perimeter region of the rear-side substrate 20. Therefore, when forming the ribs 23, a spacer 40 of the same thickness as the ribs 23 can be formed in this perimeter region. Next, fluorescent layers 24 are formed between the ribs on the address electrodes.

Next, as shown in FIG. 13(*h*), the micro-sheet 30 and the rear-side substrate 20 are bonded together and sealed. In this process, since the micro-sheet 30 does not have similar strength to the glass substrate, a pressure substrate acting as a weight is mounted on the micro-sheet 30 covering the whole surface thereof. Since a spacer 40 of the same thickness as the ribs 23 is formed at the edges of the rear-side substrate 20, there is no distortion of the micro-sheet 30 and no damage is caused to the micro-sheet 30. A low-melting-point glass paste for sealing is screen printed onto the outer sides of the spacer 40 to from a sealing material 25, and it is annealed at about 400° C. to seal the two elements 20, 30 together.

As shown in FIG. 13(*i*), a liquid dielectric material 42 is inserted between the micro-sheet 30 and the display-side glass substrate 10 when they are laminated together. In this process, a predetermined quantity of silicon oil, or the like, having a low viscosity of 450 cp., for example, is coated onto a particular central region of the micro-sheet 30. Thereupon, by superimposing the display-side substrate 10 and applying weight, the coated silicon oil can be permeated fully into the spaces between the X, Y electrodes 11, 12 by means of capillary action. Consequently, no spaces are formed between the display-side substrate 10 and the micro-sheet 30.

As described above, according to this fabrication method, fracturing or damaging of the micro-sheet 30 in the process of sealing the glass micro-sheet 30 to the rear-side substrate 20 can be prevented by the presence of a spacer 40. The spaces between the display-side substrate 10 and the micro-sheet 30 are also eliminated, thus making it possible to prevent arc discharges which occur when such spaces are formed.

Figures 14E, 14F, 14G, 14H:
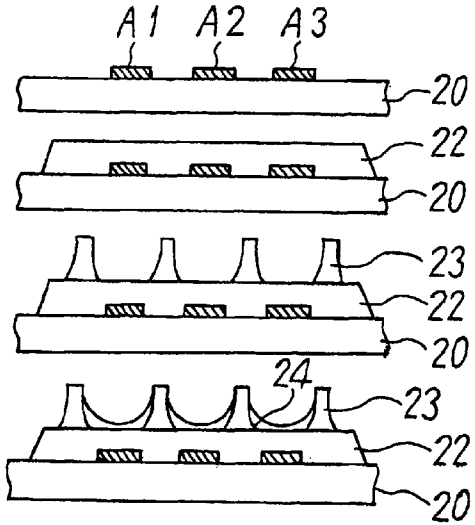
FIGS. 14A–14I show sectional views illustrating a modification of the second manufacturing process shown in FIG. 4.
Figures 14A, 14B, 14C, 14D:
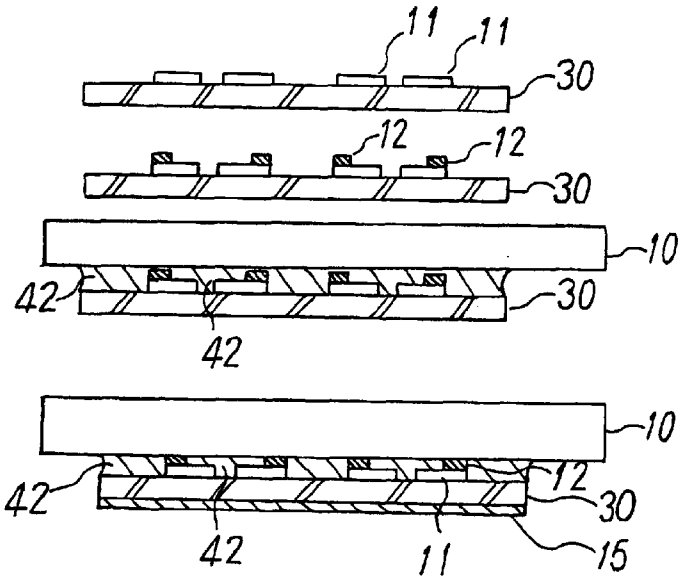
Figure 14I:
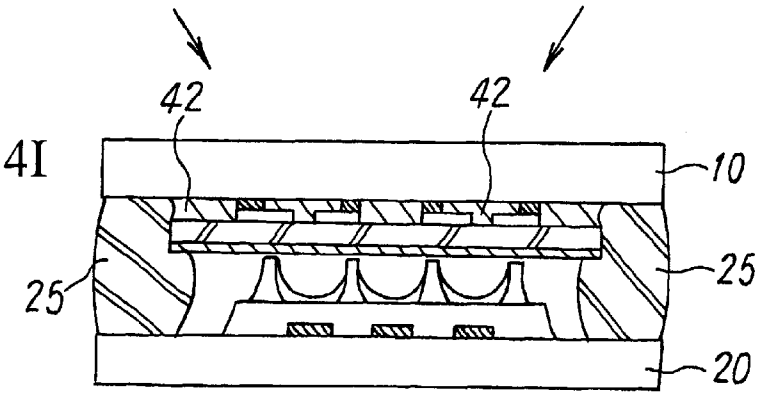

FIG. 14 gives sectional views showing a modification of the second manufacturing process illustrated in FIG. 4. In this manufacturing process, X, Y electrodes 11, 12 are formed onto a micro-sheet 30, the micro-sheet 30 is laminated to a display-side substrate 10, and finally, a rear-side substrate 20 onto which address electrodes and ribs have been formed is sealed thereon. Therefore, in this process, a liquid dielectric material is used in the step of laminating the micro-sheet 30 and the display-side substrate 10.

In FIGS. 14(*a*) and (*b*), the X, Y electrodes 11, 12 are formed onto the micro-sheet 30 by sputtering and lithography, similarly to the method in FIG. 4. Next, in FIG. 14(*c*), the micro-sheet 30 and display-side substrate 10 are laminated together using a liquid dielectric material 42. In this case, for example, a predetermined quantity of silicon oil is coated onto a specific region of the display-side glass substrate 10, and the micro-glass sheet 30 is superimposed thereon. A pressure plate (not illustrated) which applies weight to the whole surface is placed on the micro-sheet, and the silicon oil permeates fully into the spaces between the electrodes by means of capillary action. Therefore, the area between the display-side substrate 10 and the micro-sheet 30 is filled completely by the silicon oil 42, and no spaces are formed. Thereupon, a protective layer of MgO, or the like, is formed onto the opposite side of the micro-sheet 30 by vapor deposition. The protective layer 15 is formed after the micro-sheet has been laminated with the substrate, so that it is not damaged by the aforementioned pressure plate, when it is placed on the microsheet 30.

FIGS. 14(*e*)–(*h*) are the same as in FIG. 4. Finally, as shown in FIG. 14(*j*), the display-side substrate 10 to which the micro-sheet 30 is laminated is sealed to a rear-side substrate using a low-melting-point glass paste. As well as forming a sealing material in the perimeter region of the substrates 10, 20, this low-melting-point glass paste 25 is also printed and annealed on the perimeter region of the micro-sheet 30. Therefore, volatile gases from the dielectric material 42 consisting of silicon oil are prevented from leaking into the discharge space.

Figures 15A, 15B, 15C, 15D, 15E, 15F, 15G, 15H, 15I:
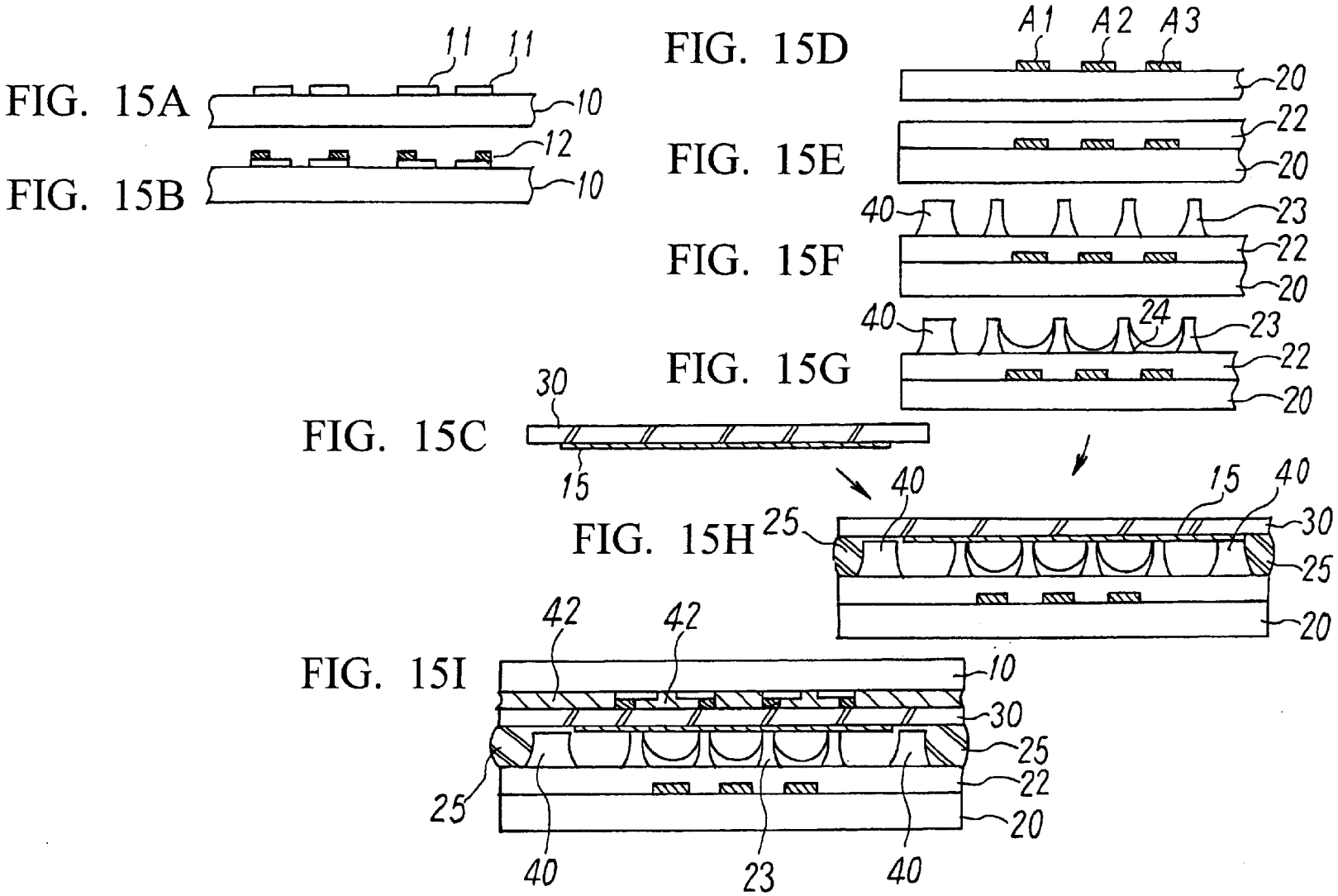
FIGS. 15A–15I show sectional views illustrating a modification of the third manufacturing process shown in FIG. 5.

FIG. 15 is a sectional view showing a modification of the third manufacturing process illustrated in FIG. 5. In this example, a rear-side substrate 20 onto which address electrodes have been formed is sealed to a micro-sheet 30, and this composition is then bonded with a display-side substrate 10 onto which X, Y electrodes have been formed, by means of a liquid dielectric material 42.

Similarly to the case in FIG. 5, in FIGS. 15(*a*) and (*b*), transparent electrodes 11 and bus electrodes 12 are formed onto a display-side glass substrate 10. In FIG. 15(*c*), similarly to FIG. 5, a protective layer 15 of MgO is formed by vapor deposition onto the glass micro-sheet 30. However, in FIGS. 15(*d*)–(*g*), address electrodes A1–A3 and a glass dielectric layer 22 covering these are formed onto a rear-side glass layer 20. A low-melting-point glass paste is printed onto the whole surface thereof and dried, whereupon the dielectric glass layer is patterned by sand-blasting to form ribs 23 and a spacer 40 in the perimeter region, and the dielectric glass layer is then annealed to fabricate the ribs 23 and spacer 40. Fluorescent layers 24 are then formed between the ribs 23.

As shown in FIG. 15(*h*), the rear-side glass substrate 20 on which the spacer 40 is formed and a glass micro-sheet 30 on which a protective layer of MgO is formed are sealed together by annealing a sealing material 25 consisting of a low-melting-point glass paste printed onto the outer sides of the spacer 40. Here, in the state illustrated in FIG. 15(*h*), a pressure plate, not shown, which applies weight to the whole surface of the micro-sheet 30 is placed thereon. However, since the spacer 40 is provided, there is no distortion of the micro-sheet 30.

Finally, as shown in FIG. 15(*i*), silicon oil is coated onto the display-side glass substrate 10, whereupon a micro-sheet 30 onto which the rear-side substrate 20 is sealed is laminated thereto. Silicon oil has a viscosity of approximately 450 cp., and it permeates into the spaces between the electrodes 11, 12 by capillary action and fills up these spaces.

Figures 16A, 16B, 16C, 16D, 16E, 16F, 16G, 16H, 16I:
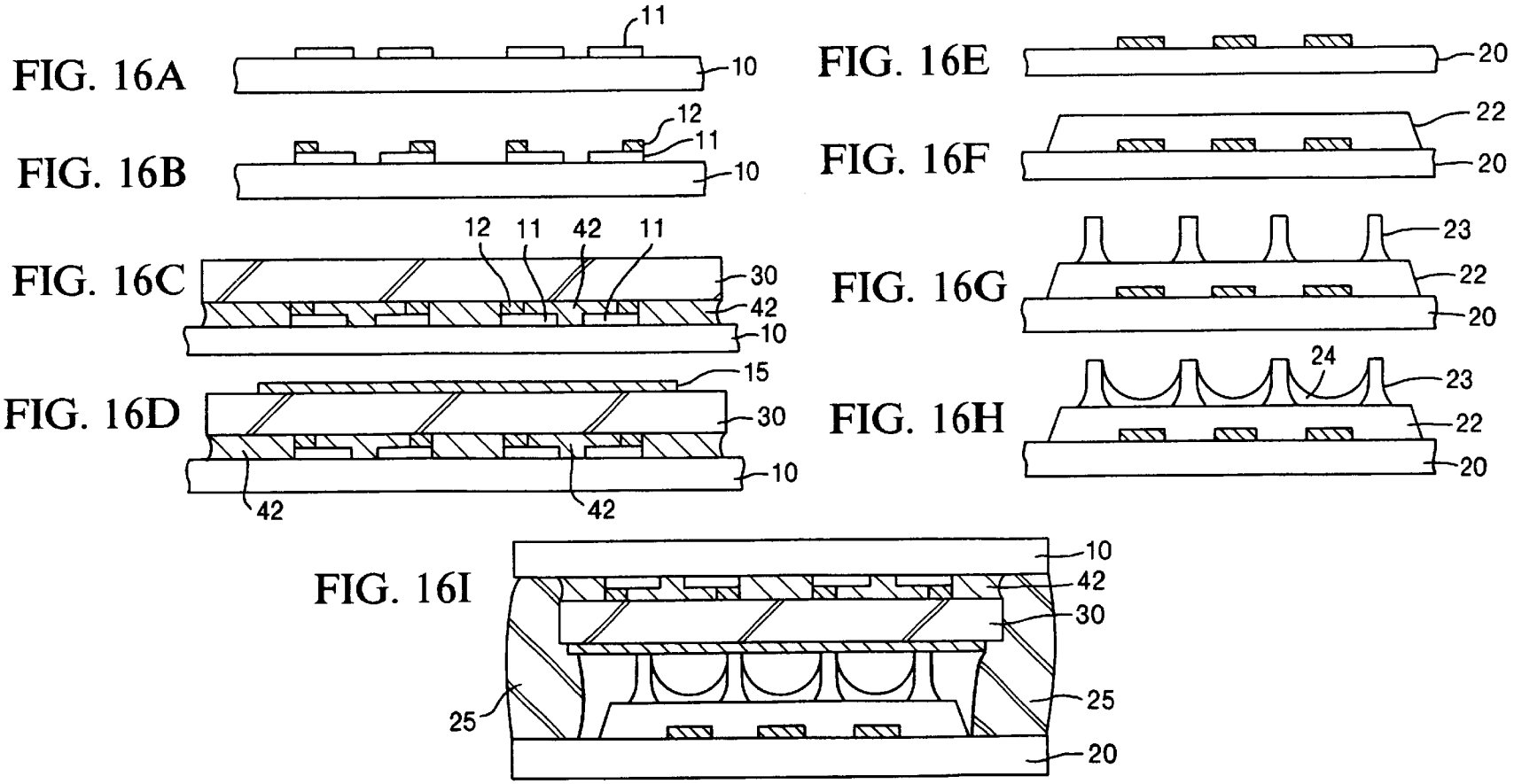
FIGS. 16A–16I show sectional views illustrating a modification of the fourth manufacturing process shown in FIG. 6.

FIG. 16 is a sectional view showing a modification of the fourth manufacturing process illustrated in FIG. 6. This example shows a manufacturing method wherein a micro-sheet 30 is laminated to a display-side glass substrate 10 onto which display electrodes are formed, whereupon it is sealed with a rear-side glass substrate 20. In this example, when laminating the micro-sheet 30 to the display-side glass substrate 10, a predetermined quantity of silicon oil of about 450 cp. viscosity is coated onto the substrate as a liquid dielectric material, and this silicon oil 42 is filled into the space between the electrodes 11, 12 by capillary action, as illustrated by FIG. 16(*c*).

As illustrated by FIG. 16(*d*), the protective layer 15 of MgO or the like is formed onto the surface of the micro-sheet 30. The processes in FIGS. 16(*e*)–(*h*) are the same as the corresponding processes in FIG. 5. Finally, the rear-side glass substrate 20 onto which address electrodes and ribs are formed is sealed to a display-side glass substrate 10 to which a micro-sheet 30 is laminated by means of a sealing material 25 consisting of a low-melting-point glass paste. The sealing material 25 is provided such that it seals the perimeter of the micro-sheet 30 also, and it prevents volatile substances from the silicon oil 42 from leaking into the discharge space.

Figure 17:
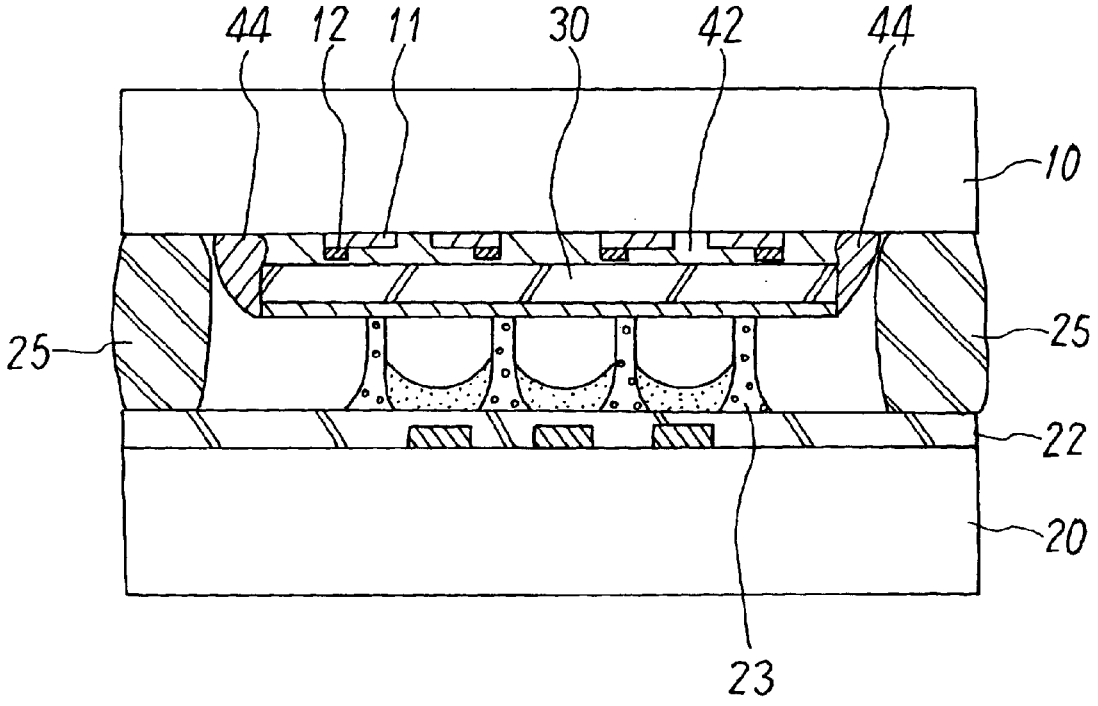
FIG. 17 is a sectional view illustrating a modification of FIG. 16.

FIG. 17 is a sectional view showing a modification of FIG. 16. In this example, in FIG. 16(*c*) or (*d*), a sealing material 44 is formed onto the perimeter of the micro-sheet 30, and the liquid silicon oil 42 and volatile components thereof are prevented from leaking externally. This sealing material 44 may, for example, be made from a low-melting-point glass, or the like, annealed at a higher temperature than the sealing material. In the subsequent sealing process, it is necessary for only the sealing of the display-side glass substrate 10 and rear-side glass substrate 20 to be ensured. Therefore, this sealing process is further simplified.

This example can be applied to the example in FIG. 14. In other words, even when X, Y electrodes 11, 12 are formed onto a micro-sheet 30, by forming a sealing material 44 onto the perimeter of the micro-sheet 30 and sealing silicon oil, in FIGS. 14(*c*) and (*d*), volatile materials from the silicon oil are prevented from leaking into the discharge space. Furthermore, it is not necessary to apply a silicon oil seal in the subsequent sealing process between the substrates.

Figure 18:
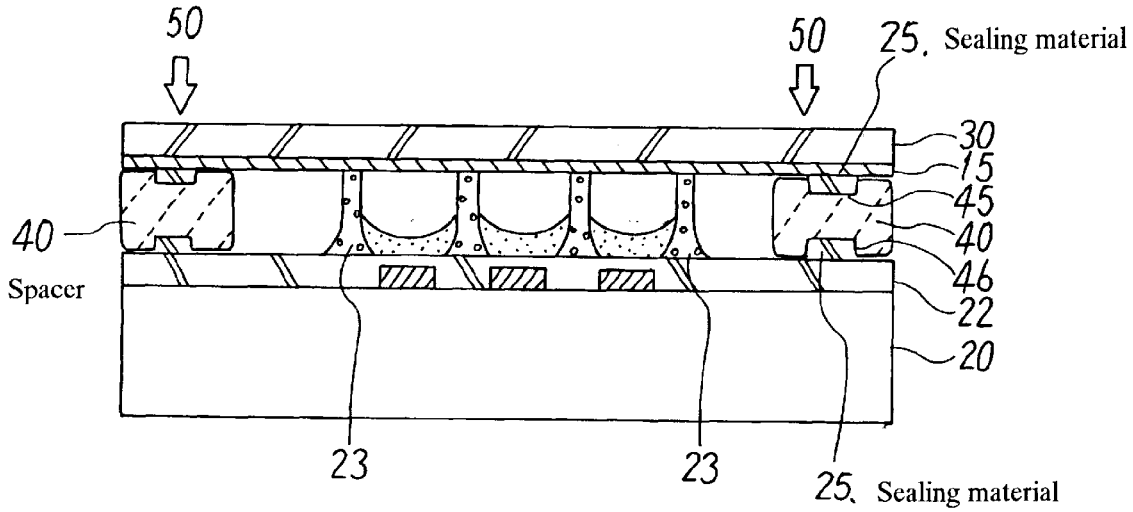
FIG. 18 is a sectional view illustrating a modification of the spacer used in FIGS. 13 and 15.

FIG. 18 is a sectional view showing a modification of a spacer used in FIGS. 13 and 15. In this example, a glass plate, resin plate, metal plate (high-melting-point metal, such as nickel, or the like) is used as the spacer 40 when sealing the rear-side glass substrate 20 and the glass micro-sheet 30. These plates are all of similar thickness to the ribs 23, and cavities 45, 46 are formed on both sides thereof. Epoxy resin, for example, is coated into these cavities as a sealing material. The spacer 40 is inserted between the rear-side substrate 20 and the glass micro-sheet 30. For example, the epoxy resin forming the sealing material hardens between room temperature and 150° C., and seals the discharge space.

In this sealing process, pressure is applied to the perimeter region of the micro-sheet 30 as indicated by the arrow 50. In other words, by using epoxy resin as a sealing material, the sealing process can be conducted at a lower temperature than with conventional low-melting-point glass, and hence there is little deformation of the micro-sheet 30 and pressure only needs to be applied in the perimeter region during the sealing process.

Figure 19:
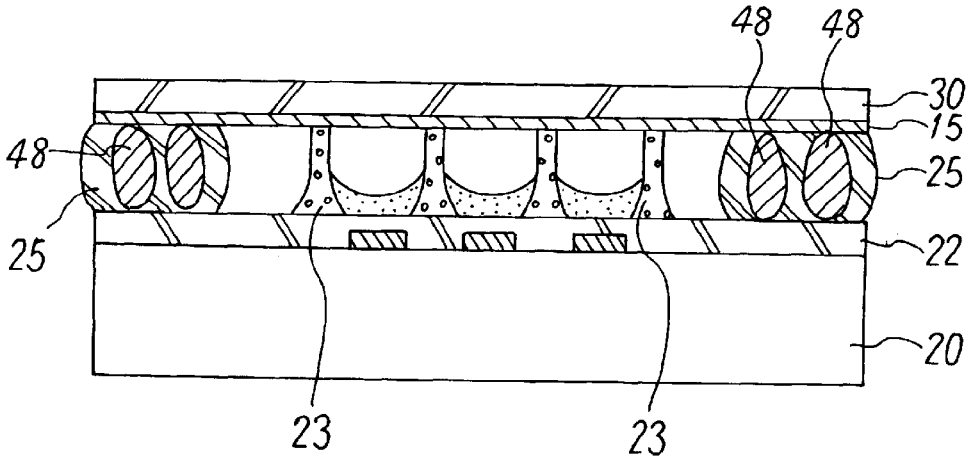
FIG. 19 is a sectional view illustrating a further modification of the spacer used in FIGS. 13 and 15.

FIG. 19 is a sectional view showing a further modification of a spacer used in FIGS. 13 and 15. In the example in FIG. 19, glass beads 48 of even diameter are used for the spacer. Glass beads are often used as a spacer between substrates in liquid-crystal display panels. In this example, glass beads 48 having a diameter similar to the thickness of the ribs 23 are mixed into a low-melting-point glass paste, and this mixture is coated onto the perimeter region of the rear-side glass substrate 20. The low-melting-point glass paste 25 is annealed at a high temperature in the region of the melting point of the glass paste. Consequently, in the annealing process, it is possible to prevent stress from being applied to the perimeter region of the micro-sheet 30. In this case, using epoxy resin as a sealing material, the sealing can be carried out by means of a low-temperature process.

As described above, according to the present invention, a dielectric layer is formed onto the glass substrate of a PDP by laminating a micro-sheet, and therefore it is possible to avoid the complicated and time-consuming processes of printing and annealing. Furthermore, since high-temperature annealing processing is eliminated, it is possible to use reinforced glass for the display-side glass substrate, for example. Moreover, it is possible to form the black strip layers and the colour film layers from organic materials, which have poor thermal resistance.

Furthermore, by inserting a liquid dielectric material when laminating a thin film micro-sheet to a display side substrate with the display-side electrodes therebetween, it is possible to prevent spaces from being formed between the display electrodes, and thereby to prevent the occurrence of arc discharges.

Moreover, by providing a spacer of similar thickness to the ribs around the perimeter of the rear-side substrate when sealing a thin film micro-sheet to the rear-side substrate, it is possible to prevent the occurrence of distortion and damage in the micro-sheet.

What is claimed is:

1. A method of manufacturing a plasma display panel comprising a first substrate having a plurality of first electrodes, a second substrate having a plurality of second electrodes provided in an orthogonal direction to said first electrodes, and a discharge space between the two substrates, comprising:

sealing a dielectric thin film sheet, on the surface of which said first electrodes are formed, and the second substrate, on which said second electrodes are formed, such that said discharge space is formed therebetween; and attaching said first substrate to said sealed dielectric thin film sheet.

2. The method of manufacturing a plasma display panel according to claim 1, further comprising the step of bonding a thin film of conductive material to the surface of said dielectric thin film sheet and forming said first electrodes by etching said thin film of conductive material in a prescribed pattern.

3. The method of manufacturing a plasma display panel according to claim 2, wherein:

the step of bonding a thin film of conductive material to the surface of said dielectric thin film sheet is carried out by electrostatic bonding whereby said thin film sheet and said thin film of conductive material are bonded by applying a voltage therebetween.

4. The method of manufacturing a plasma display panel according to claim 1, wherein:

said first substrate is a reinforced glass substrate or a reinforced plastic substrate.

5. The method of manufacturing a plasma display panel according to claim 1, wherein:

in said sealing operation, a spacer of a prescribed thickness is inserted between said second substrate and said thin film sheet in the perimeter region thereof.

6. The method of manufacturing a plasma display panel according to claim 5, further comprising, prior to said sealing operation, the operation of forming ribs onto said second substrate in positions between said second electrodes, and forming said spacer onto said second substrate in the perimeter region thereof.

7. The method of manufacturing a plasma display panel according to claim 5, further comprising, prior to said sealing operation, the operation of forming onto said second substrate in the perimeter region thereof a spacer having a prescribed thickness made from any one of: glass beads, glass plate, ceramic plate, resin plate, or metal plate.

8. The method of manufacturing a plasma display panel according to claim 1, wherein:

in the operation of attaching said first substrate to said thin film sheet, a dielectric material in liquid form is coated in between said thin film sheet and the first substrate, and the space between said first electrodes is filled by said dielectric material in liquid form.

9. The method of manufacturing a plasma display panel according to claim 8, wherein:

said dielectric material in liquid form is any one of: silicon oil, silicon gum, epoxy resin, ultraviolet-setting resin, anaerobic adhesive, or a thermoplastic resin.

10. A method of manufacturing a plasma display panel comprising a first substrate having a plurality of first electrodes, a second substrate having a plurality of second electrodes provided in an orthogonal direction to said first electrodes, and a discharge space between the two substrates, comprising:

laminating a dielectric thin film sheet, on the surface of which said first electrodes are formed, on said first substrate; and sealing the first substrate, to which said thin film sheet is laminated, and the second substrate, onto which said second electrodes are formed, such that said discharge space is formed therebetween.

11. The method of manufacturing a plasma display panel according to claim 10, wherein:

said first substrate is a glass substrate, and the step of laminating said first substrate to said dielectric thin film sheet is carried out by electrostatic bonding whereby said thin film sheet and said first substrate are bonded by applying a voltage therebetween.

12. The method of manufacturing a plasma display panel according to claim 10, wherein:

said first substrate is a glass substrate, and the operation of laminating said first substrate to said dielectric thin film sheet is carried out by bonding the two elements by applying pressure thereto in an atmosphere above the transition temperature of said glass.

13. The method of manufacturing a plasma display panel according to claim 10, further comprising the operation of bonding a thin film of conductive material to the surface of said dielectric thin film sheet, and forming said first electrodes by etching said thin film of conductive material in a prescribed pattern.

14. The method of manufacturing a plasma display panel according to claim 13, wherein:

the operation of bonding the thin film of conductive material to the surface of said dielectric thin film sheet is carried out by electrostatic bonding whereby said thin film sheet and the thin film of conductive material are bonded by applying a voltage therebetween.

15. The method of manufacturing a plasma display panel according to claim 10, wherein:

in the operation of laminating said first substrate to said dielectric thin film sheet, a dielectric material in liquid form is coated in between said thin film sheet and the first substrate, and the space between said first electrodes is filled with said dielectric material in liquid form.

16. The method of manufacturing a plasma display panel according to claim 15, wherein:

said dielectric material in liquid form is any one of: silicon oil, silicon oil, epoxy resin, ultraviolet-setting resin, anaerobic adhesive, or a thermoplastic resin.

17. A method of manufacturing a plasma display panel comprising a first substrate having a plurality of first electrodes, a second substrate having a plurality of second electrodes provided in parallel, a second substrate having a plurality of second electrodes provided in an orthogonal direction to said first electrodes, and a discharge space between the two substrates, comprising:

sealing a dielectric thin film sheet and the second substrate, whereon said second electrodes are formed, such that said discharge space is formed therebetween; and attaching said first substrate, whereon said first electrodes are formed, to said sealed dielectric thin film sheet.

18. The method of manufacturing a plasma display panel according to claim 17, further comprising bonding a thin film of conductive material onto the surface of said first substrate and forming said first electrodes by etching said thin film of conductive material in a prescribed pattern.

19. The method of manufacturing a plasma display panel according to claim 18, wherein:

the operation of bonding a thin film of conductive material to the surface of said first substrate is carried out by electrostatic bonding whereby said dielectric sheet and said thin film of conductive material are bonded by applying a voltage therebetween.

20. The method of manufacturing a plasma display panel according to claim 17, wherein:

said first substrate is a reinforced glass substrate or reinforced plastic substrate.

21. The method of manufacturing a plasma display panel according to claim 17, wherein:

in said sealing operation, a spacer of a prescribed thickness is inserted between said second substrate and said thin film sheet in the perimeter region thereof.

22. The method of manufacturing a plasma display panel according to claim 21, further comprising, prior to said sealing operation, the operation of forming ribs on said second substrate in positions between said second electrodes and forming said spacer on said second substrate in the perimeter region thereof.

23. The method of manufacturing a plasma display panel according to claim 21, further comprising, prior to said sealing operation, the operation of forming a spacer of a prescribed thickness made from any one of: glass beads, glass plate, ceramic plate, resin plate, or metal plate, onto said second substrate in the perimeter region thereof.

24. The method of manufacturing a plasma display panel according to claim 17, wherein:

in the operation of attaching said first substrate to said thin film sheet, a dielectric material in liquid form is coated in between said thin film sheet and said first substrate, and the space between said first electrodes is filled by said dielectric material in liquid form.

25. The method of manufacturing a plasma display panel according to claim 24, wherein:

said dielectric material in liquid form is any one of silicon oil, silicon gum, or epoxy resin.

26. A method of manufacturing a plasma display panel comprising a first substrate having a plurality of first electrodes, a second substrate having a plurality of second electrodes provided in an orthogonal direction to said first electrodes, and a discharge space between the two substrates, comprising:

laminating a dielectric thin film sheet to the first substrate, whereon said first electrodes are formed, such that the dielectric thin film sheet covers said first electrodes; and sealing the first substrate, to which said thin film sheet is laminated, and the second substrate, on which said second electrodes are formed, such that said discharge space is formed therebetween.

27. The method of manufacturing a plasma display panel according to claim 26, wherein:

said first substrate is a glass substrate, and the operation of laminating said first substrate to said dielectric thin film sheet is carried out by electrostatic bonding whereby said thin film sheet and said first substrate are bonded by applying a voltage therebetween.

28. The method of manufacturing a plasma display panel according to claim 26, wherein:

said first substrate is a glass substrate, and the operation of laminating said first substrate to said dielectric thin film sheet is carried out by bonding the two elements by applying pressure thereto in an atmosphere above the transition temperature of said glass.

29. The method of manufacturing a plasma display panel according to claim 26, wherein:

in the operation of laminating said first substrate to said thin film sheet, a dielectric material in liquid form is coated in between said thin film sheet and first substrate, and the space between said first electrodes is filled by said dielectric material in liquid form.

30. The method of manufacturing a plasma display panel according to claim 29, wherein:

said dielectric material in liquid form is any one of: silicon oil, silicon gum, or epoxy resin.

31. A plasma display panel including a first substrate having a plurality of first electrodes, a second substrate having a plurality of second electrodes provided in an orthogonal direction to said first electrodes, and a discharge space between the two substrates, wherein:

a dielectric thin film sheet is laminated between said first electrodes and said discharge space; and said first substrate and second substrate are sealed together, leaving said discharge space therebetween, said first and second electrodes being positioned on the inner side thereof.

32. The plasma display panel according to claim 31, wherein:

a dielectric material is filled in between said first substrate and said thin film sheet.

33. The plasma display panel according to claim 31, wherein:

a spacer is inserted between said second substrate and said thin film sheet in the perimeter region thereof.

34. An assembly structure for a plasma display panel comprising a first substrate having a plurality of first electrodes, a second substrate having a plurality of second electrodes provided in an orthogonal direction to said first electrodes, and a discharge space between the two substrates, the assembly structure comprising:

a dielectric thin film sheet, on one side of which said first electrodes are formed and on the other side of which a protective layer with respect to the discharge effect is formed, wherein the assembly structure is capable of being laminated to said first substrate.

* * * * *

UNITED STATES PATENT AND TRADEMARK OFFICE

CERTIFICATE OF CORRECTION

PATENT NO. : 6,242,859 B1
DATED : June 5, 2001
INVENTOR(S) : Keiichi Betsui et al.

It is certified that error appears in the above-identified patent and that said Letters Patent is hereby corrected as shown below:

Column 16,
Line 54, delete "the step of".

Column 18,
Line 17, delete "silicon oil," (second occurrence).

Signed and Sealed this

Nineteenth Day of February, 2002

*Attest:*

*Attesting Officer*

JAMES E. ROGAN
*Director of the United States Patent and Trademark Office*